US009539630B2

(12) United States Patent
Mizumura et al.

(10) Patent No.: US 9,539,630 B2
(45) Date of Patent: Jan. 10, 2017

(54) METHOD FOR BENDING SHEET METAL AND PRODUCT OF SHEET METAL

(75) Inventors: Masaaki Mizumura, Tokyo (JP); Koichi Sato, Tokyo (JP); Satoshi Shirakami, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 277 days.

(21) Appl. No.: 14/002,305

(22) PCT Filed: Mar. 5, 2012

(86) PCT No.: PCT/JP2012/055590
§ 371 (c)(1),
(2), (4) Date: Sep. 3, 2013

(87) PCT Pub. No.: WO2012/118223
PCT Pub. Date: Sep. 7, 2012

(65) Prior Publication Data

US 2013/0333190 A1 Dec. 19, 2013

(30) Foreign Application Priority Data

Mar. 3, 2011 (JP) ..... 2011-046254
Mar. 3, 2011 (JP) ..... 2011-046581

(51) Int. Cl.
*B21D 5/02* (2006.01)
*B21D 5/00* (2006.01)
(Continued)

(52) U.S. Cl.
CPC ..... *B21D 5/02* (2013.01); *B21D 5/008* (2013.01); *B21D 35/005* (2013.01); *C21D 1/09* (2013.01);
(Continued)

(58) Field of Classification Search
CPC ..... B21D 5/02; B21D 35/005; B21D 5/008; B21D 5/00; B21D 11/20; B21D 11/203; B21D 5/08; C21D 1/30; C21D 7/13; C21D 7/10; C21D 1/09; C21D 1/32; C21D 2221/10; C21D 1/06–1/25; C21D 1/52; C21D 1/60; Y10T 29/49826
See application file for complete search history.

(56) References Cited

U.S. PATENT DOCUMENTS 4,770,018 A 9/1988 Bosl et al.
5,359,872 A 11/1994 Nashiki
(Continued)

FOREIGN PATENT DOCUMENTS

CN 101717850 A 6/2010
CN 101802228 A 8/2010
(Continued)

OTHER PUBLICATIONS

Translated Japanese Patent Publication No. 2007-268554-A published on Oct. 18, 2007.*
(Continued)

*Primary Examiner* — David Bryant
*Assistant Examiner* — Jun Yoo
(74) *Attorney, Agent, or Firm* — Birch, Stewart, Kolasch & Birch, LLP

(57) ABSTRACT

A method for bending a sheet metal comprises: a hardness adjustment process wherein a blank (10), including a high-hardness region (11) and a low-hardness region (12) having a lower hardness than the high hardness region (11), is formed by changing the hardness of at least a part of a sheet metal; and a bending process wherein a product (20) is formed by bending low-hardness region (12) of blank (10).

27 Claims, 22 Drawing Sheets

(51) Int. Cl.

| | |
|---|---|
| ***C21D 7/10*** | (2006.01) |
| ***C21D 7/13*** | (2006.01) |
| ***C21D 1/09*** | (2006.01) |
| ***C21D 1/30*** | (2006.01) |
| ***C21D 1/32*** | (2006.01) |
| ***B21D 35/00*** | (2006.01) |

(52) U.S. Cl.
CPC . *C21D 1/30* (2013.01); *C21D 1/32* (2013.01); *C21D 7/10* (2013.01); *C21D 7/13* (2013.01); *C21D 2221/10* (2013.01); *Y10T 29/49826* (2015.01)

(56) References Cited

U.S. PATENT DOCUMENTS

| | | | | |
|---|---|---|---|---|
| 8,691,032 | B2 * | 4/2014 | Thomas | C21D 1/673 148/643 |
| 2004/0211235 | A1 | 10/2004 | Todaka et al. | |
| 2010/0132854 | A1 * | 6/2010 | Cola, Jr. | C21D 1/08 148/575 |
| 2011/0011499 | A1 | 1/2011 | Lengauer et al. | |
| 2013/0174942 | A1 * | 7/2013 | Bonnet | B22D 25/06 148/546 |

FOREIGN PATENT DOCUMENTS

| | | | |
|---|---|---|---|
| EP | 0816520 | A2 | 1/1998 |
| GB | 897818 | A | 5/1962 |
| JP | 63-188426 | A | 8/1988 |
| JP | 63-502733 | A | 10/1988 |
| JP | 1-233019 | A | 9/1989 |
| JP | 2-6019 | A | 1/1990 |
| JP | 5-215 | U | 1/1993 |
| JP | 5-177366 | A | 7/1993 |
| JP | 08-040158 | A | 2/1996 |
| JP | 10-273790 | A | 10/1998 |
| JP | 11-140537 | A | 5/1999 |
| JP | 11-152541 | A | 6/1999 |
| JP | 2000-158046 | A | 6/2000 |
| JP | 2003-19516 | A | 1/2003 |
| JP | 2003-328031 | A | 11/2003 |
| JP | 2004-276078 | A | 10/2004 |
| JP | 2005-161366 | A | 6/2005 |
| JP | 2005-169394 | A | 6/2005 |
| JP | 2006-300140 | A | 11/2006 |
| JP | 2007-268554 | A | 10/2007 |
| JP | 2008-246555 | A | 10/2008 |
| JP | 2008-284599 | A | 11/2008 |
| JP | 2010-36208 | A | 2/2010 |
| JP | 2010-75935 | A | 4/2010 |
| JP | 2010-179317 | A | 8/2010 |

OTHER PUBLICATIONS

International Search Report issued in PCT/JP2012/055590, mailed Jun. 5, 2012.

Extended European Search Report, dated Oct. 16, 2014, for European Application No. 12752145.8.

* cited by examiner

METHOD FOR BENDING SHEET METAL AND PRODUCT OF SHEET METAL

TECHNICAL FIELD

The present invention relates to a method for bending a sheet metal, capable of easily bending the sheet metal without generating a problem such as a crinkle, crack or springback, and relates to a product manufactured by the bending method.

BACKGROUND ART

In the prior art, by bending sheet metal, constituted from iron, aluminum or alloy thereof, in a predetermined shape, various products have been manufactured for use in a vehicle such as a motorcar, components, building materials, or furniture. As the bending method, for example, a roll forming method for continuously deforming an object, or press working by means of a press brake, may be possible.

As a method for bending a sheet metal, PLT 1 discloses a continuous manufacturing method, wherein a bent portion of a sheet material is locally heated and softened while the sheet material is moved, and then the sheet material is transmitted through rolls or a forming device.

CITATION LIST

Patent Literature

PLT 1: Japanese Patent Publication (A) No. S63-188426

SUMMARY OF INVENTION

Problem to be Solved by the Invention

However, in the technique of PLT 1, it is necessary to process the entirety of one coil when the coil is manufactured, since a coil-shaped plate is continuously processed. Therefore, the technique is not adequate for low-volume production. Further, there is a problem regarding a space in the technique, since a device such a laser must be arranged on a production line.

On the other hand, in recent years, as a product for use in a motorcar, a high-strength sheet metal (for example, a high-strength steel plate having tensile strength of 980 MPa or more) is used in order to reduce the weight of the vehicle. However, the workability of the steel plate is usually deteriorated as the strength of the steel plate is increased, i.e., a crinkle or crack is easily generated in a deformed portion and a springback is easily generated in the product. Therefore, a method for bending a sheet metal without generating a crinkle or crack in a deformed portion is desired, even when the sheet metal has a tensile strength of 980 MPa or more.

Further, a product constituted from the high-strength sheet metal is subject to compressing or bending force during use. Concretely, a front-side member of a motorcar is subjected to compressing load in the axial direction (or the front-back direction of the body) in a head-on collision, a side sill of a motorcar is subjected to bending load when lateral collision, and a bumper is subjected to bending load in a head-on collision, for example. Therefore, it is necessary that a crack not be generated in the deformed portion of the product not only in the bending process but also when the product is subjected to such load.

The present invention was made in order to solve the above problems in the prior art, and to provide a method for bending a sheet metal, capable of easily bending the sheet metal without generating a problem such as a crinkle, crack or springback of the deformed portion, and a product manufactured by the bending method.

Means for Solving the Problem

According to the present invention, a method for bending a sheet metal is provided, the method comprising: a hardness adjusting process for changing hardness of at least a part of the sheet metal so as to form a blank including a high-hardness region and a low-hardness region having hardness lower than hardness of the high-hardness region; and a bending process for bending the low-hardness region of the blank so as to form a product.

The hardness adjusting process may comprise forming an objective region to be processed in at Least a part of the sheet metal, wherein one side of the sheet metal is formed as the low-hardness region and the other side of the sheet metal is formed as the high-hardness region.

Effects of Invention

In the method for bending a sheet metal of the present invention, bending process can be properly carried out without generating a crinkle or crack in a deformed portion of a product or springback in the product, by bending the low-hardness region of a blank. Therefore, according to the method for bending a sheet metal of the invention, a product having a predetermined shape can be easily manufactured. Further, in the method for bending a sheet metal of the invention, even when a high-strength sheet metal having tensile strength of 980 MPa or more, for example, a portion deformed in the bending process becomes the low-hardness region in the hardness adjusting process. Therefore, the deformed portion can be bent without generating a crack therein. Accordingly, the method of the invention is suitable for manufacturing components of a motorcar (for example, a front side member, a side sill and a bumper), building materials, or furniture by using a high-strength sheet metal.

The method for bending a sheet metal of the present invention includes the hardness adjusting process for changing hardness of the sheet metal so as to form a blank having a high-hardness region and a low-hardness region having hardness lower than hardness of the high-hardness region. Therefore, a sheet metal having different hardness required for a product may be used, whereby a usable sheet metal may have a wide range of hardness in comparison to when only a part of the sheet metal is softened.

In the method for bending a sheet metal of the present invention, since a previously prepared blank is bent and deformed in the hardness adjusting process, it is not necessary to continuously carry out the hardness adjusting process and the bending process. Therefore, the present invention is advantageous to low-volume production, and is also advantageous in terms of a space, since it is not necessary to arrange a device such as a laser on a line.

Further, in the product of the present invention, the hardness of the deformed portion deformed in the bending process is lower than a portion which is not deformed, whereby a crack is not generated in the deformed portion when bending load applied to the product is gradually increased. However, in a product having the same hardness throughout as a non-deformed portion, a crack may be generated in the deformed portion when bending load is gradually increased, whereby a stress is rapidly decreased when the bending load exceeds a maximum load in many cases. On the other hand, in the invention, a crack is not generated in the deformed portion, a stress is gradually decreased when the bending load exceeds a maximum load. Accordingly, in the product of the invention, a total amount of absorbed energy of the bending load is larger than the product having the same hardness throughout as the non-deformed portion, whereby the energy of the bending load is effectively absorbed in the invention.

EMBODIMENTS FOR CARRYING OUT THE INVENTION

Below, a first embodiment of the present invention will be explained while referring to the attached drawings.

A blank 10, as exemplified in FIG. 1, includes one or more (two in the example of FIG. 1) low-hardness regions 12 and a plurality of (three in the example of FIG. 1) high-hardness regions 14, the regions being formed by hardness adjusting process as described below from a sheet metal of iron, iron alloy, aluminum or aluminum alloy. Although blank 10 is a rectangular sheet material in FIG. 1, the shape and dimension of blank 10 may be variously determined depending on intended use, etc., of a product 20. Further, although low-hardness regions 12 of blank 10 extend parallel to a longitudinal direction, low-hardness regions 12 may extend non-parallel depending on the shape and intended use of product 20. Blank 10 may be a continuous web withdrawn from a coil-shaped supply, for example, when a roll forming method is used.

Figure 2:
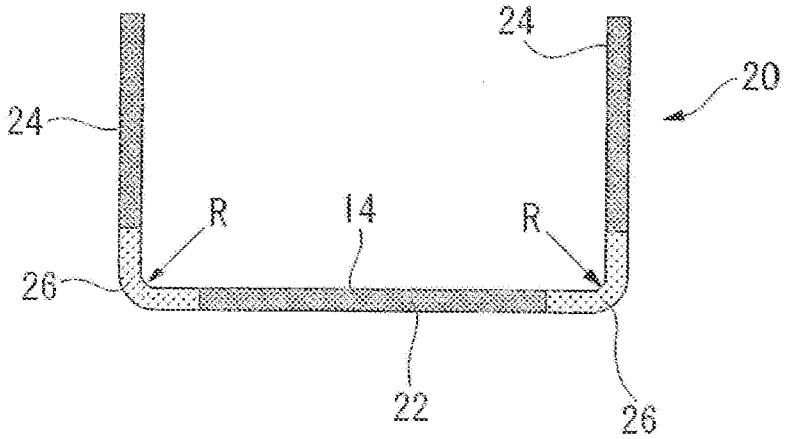
FIG. 2 is an end view of an example of a product manufactured from the sheet metal of FIG. 1 by a bending method of the first embodiment of the invention.

Blank 10 is bent along low-hardness regions 12, by roll forming or press working using a press brake, and formed as channel-shaped product 20 have a C-shaped or cup-shaped cross-section, as shown in FIG. 2. In FIG. 2, product 20 is a channel-shaped member having a generally C-shaped cross-section, including a bottom wall 22, and opposed side walls 24 vertically extending from both side edges of bottom wall 22. Product 20 has two deformed portions or edge portions 26, which are formed from low-hardness regions 12 and extend in the longitudinal direction. Each deformed portion or edge portion 26 has a bend radius "R."

A width "B" of low-hardness region 12 may be determined depending on bend radius R of deformed portion 26 of product 20. For example, as shown in FIG. 2, when deformed portion 26 of product 20 has a band-shape which is deformed so as to have constant bend radius R, it is preferable that width B of low-hardness region 12 be $0.5\pi R$ to $1.5\pi R$, as shown in FIGS. 1 and 2. By virtue of low-hardness region 12 having width B within this range, product 20 may have sufficient strength and workability of blank 10 is effectively improved in bending process.

In order that blank 10 has improved workability while having sufficient strength, it is preferable that the hardness of low-hardness region 12 be within a range from 30% to 70% of the hardness of high-hardness region 14. When the hardness of low-hardness region 12 is too low, the strength of product 20 is insufficient even when the hardness of high-hardness region 14 is increased. On the other hand, when the hardness of low-hardness region 12 is too high, the workability in the bending process is insufficient when the hardness of high-hardness region 14 is high.

In the preferred embodiment of the invention, in the hardness adjusting process, blank 10 is formed by (1) changing the hardness of the entirety of the sheet metal; or (2) changing the hardness of a part region of the sheet metal so as to form one or more low-hardness regions 12 in the sheet metal.

A method for forming blank 10 by changing the hardness of the entirety of the sheet metal, for example, includes a heating process for heating the entirety of the sheet metal by means of a heating furnace (not shown) or another heating device; and a hardening process for quenching only a region to be high-hardness region 14 of the heated sheet metal. The hardening process may be carried out, for example, by cooling only the region to be high-hardness region 14 by using a mold.

Figure 3:
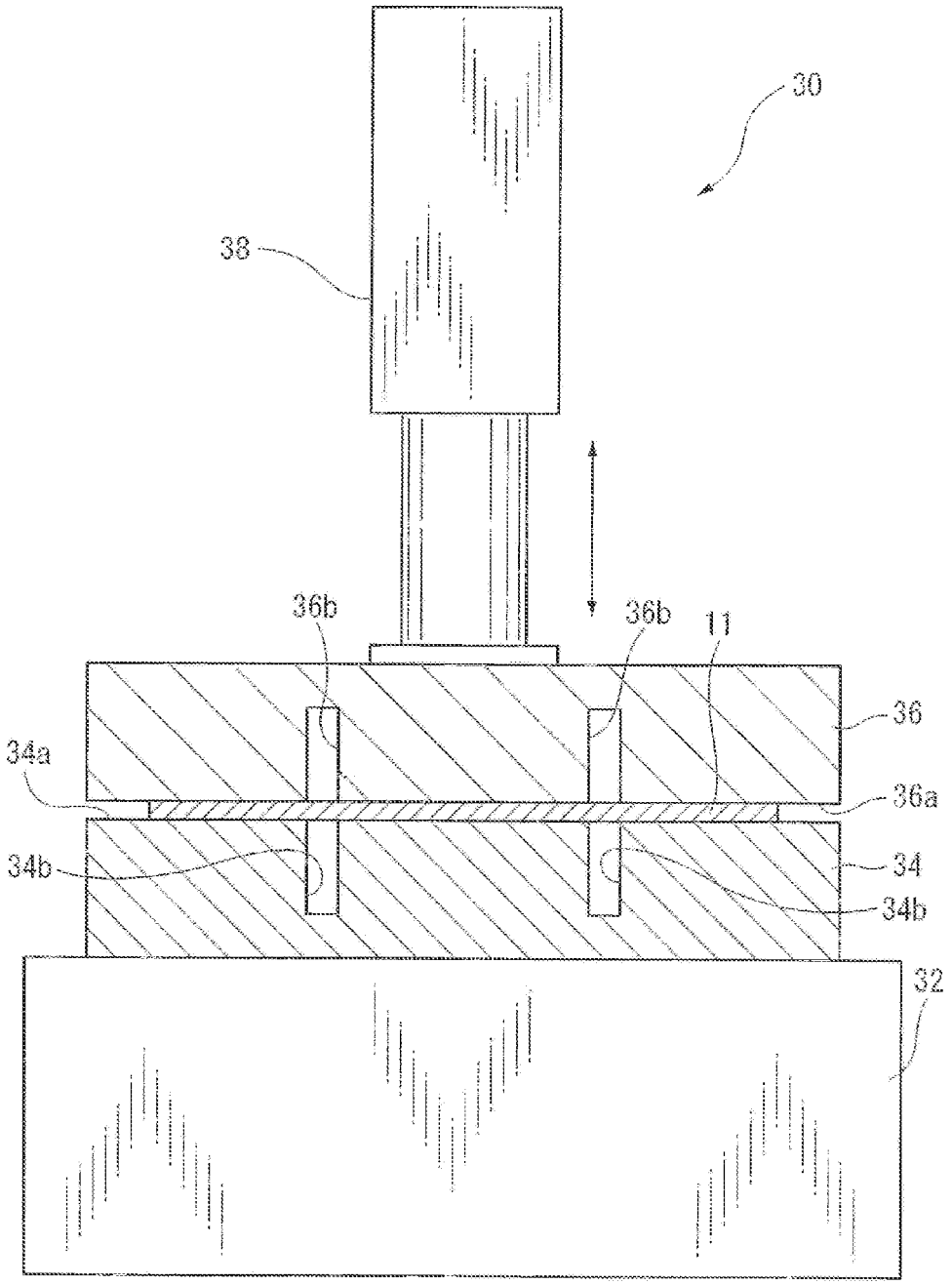
FIG. 3 is a schematic view of an example of a mold device used in hardness adjusting process of the bending method of the first embodiment for manufacturing the sheet metal of FIG. 1.

FIG. 3 shows a mold device 30 as an example of the cooling device for carrying out the hardening process of the invention. Mold device 30 includes a bed 32 fixed to a floor of a factor, etc.; a lower mold 34 fixed to an upper surface of bed 32; and an upper mold 36 configured to be moved in the vertical direction closer to or away from lower mold 34 by means of a ram or a suitable drive unit 38. Sheet metal 11 is positioned between lower mold 34 and upper mold 36. On opposed operating surfaces 34*a* and 36*a* of lower and upper molds 34 and 36, groove portions 34*b* and 36*b* are formed, respectively, at positions corresponding to low-hardness regions 12 of sheet metal 11 after the hardening process.

First, sheet metal 11 is transferred from the heating furnace or heating device to mold device 30, after being heated in the heating process, and is positioned between lower and upper molds 34 and 36. Then, upper mold 36 is moved toward lower mold 34 by means of drive unit 38 so that operating surfaces 34*a* and 36*a* of lower and upper molds 34 and 36 come into contact with sheet metal 11. In sheet metal 11, only a portion, which contacts operating surfaces 34*a* and 36*a* of lower and upper molds 34 and 36, is rapidly cooled and hardened. In this regard, a portion of sheet metal 11, which faces groove portions 34*b* and 36*b* of lower and upper molds 34 and 36, is not rapidly cooled by lower and upper molds 34 and 36. As such, the portion of sheet metal 11, which faces groove portions 34*b* and 36*b* of lower and upper molds 34 and 36, is gradually cooled and becomes low-hardness region 12. On the other hand, the portion, which contacts operating surfaces 34*a* and 36*a* of lower and upper molds 34 and 36, is rapidly cooled and becomes high-hardness region 14, whereby blank 10 is formed.

Figure 4:
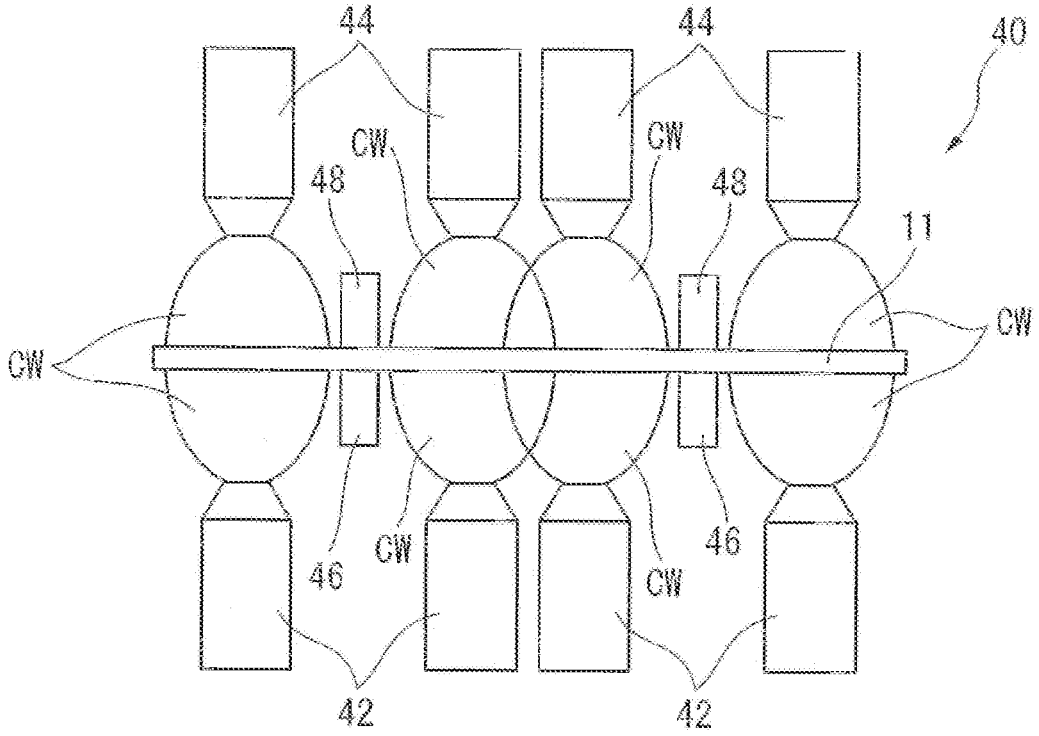
FIG. 4 is a schematic view of an example of a water-cooling device used in hardness adjusting process of the bending method of the first embodiment for manufacturing the sheet metal of FIG. 1.

Alternatively, the hardening process may be a process for selectively water-cooling only a region to be high-hardness region 14 of the sheet metal, for example, as shown in FIG. 4. FIG. 4 shows a water-cooling device 40 as an example of the cooling device for carrying out the hardening process of the invention. Water cooling device 40 includes a plurality of first (or lower) nozzles 42 which are arranged so as to face one side of sheet metal (or a lower surface of sheet metal 11 in FIG. 4); a plurality of second (or upper) nozzles 44 which are arranged so as to face the opposed side of sheet metal (or an upper surface of sheet metal 11 in FIG. 4), wherein cooling water CW can be supplied to the sides of sheet metal 11. Lower nozzles 42 and upper nozzles 44 are positioned so as to face a portion of sheet metal 11 which becomes be high-hardness region 14 after the hardening process. In order to prevent a portion of sheet metal 11, which becomes low-hardness region 12 after the hardening process, from being wetted with cooling water CW, water cooling device 40 may have lower and upper masking members 46 and 48, which are positioned to cover the portion of sheet metal 11 which becomes low-hardness region 12 after the hardening process. Lower and upper masking members 46 and 48 may have a drive unit such as a hydraulic cylinder (not shown) for moving the masking members closer to or away from sheet metal 11. Further, lower and upper masking members 46 and 48 may function as a clamper for correctly positioning and holding sheet metal 11 relative to lower and upper nozzles 42 and 44. Alternatively, water cooling device 40 may have another clamper for correctly positioning and holding sheet metal 11 relative to lower and upper nozzles 42 and 44.

First, sheet metal 11 is transferred from the heating furnace or heating device to water cooling device 40, after being heated in the heating process, and is positioned between lower and upper nozzles 42 and 44. In this regard, lower and upper masking members 46 and 48 may be used as the clamper for correctly positioning and holding sheet metal 11 relative to lower and upper nozzles 42 and 44. Alternatively, as described above, another clamper (not shown) may be used for correctly positioning said holding sheet metal 11 relative to lower and upper nozzles 42 and 44. Then, cooling water CW is supplied from lower and upper nozzles 42 and 44 to a portion of sheet metal 11, which becomes high-hardness region 14 after the hardening process, so that this portion is rapidly cooled and hardened. In this regard, by using lower and upper masking members 46 and 48, a portion of sheet metal 11, which becomes low-hardness region 12 after the hardening process, is prevented from being wetted by cooling water CW and from being rapidly cooled. As such, the portion of sheet metal 11, which faces lower and upper masking members 46 and 48, is gradually cooled and becomes low-hardness region 12, and the other portion is rapidly cooled and becomes high-hardness region 14, whereby blank 10 is formed.

A method for forming blank 10 by changing the hardness of a part region of the sheet metal, for example, includes a welding process for positioning another sheet metal, having hardness different from the hardness of the sheet metal, in a region to be high-hardness region 14 or low-hardness region 12, and welding the sheet metals to each other. By virtue of this method, blank 10 is obtained, wherein one region of high-hardness region 14 and low-hardness region 12 is formed by the same material as the sheet metal, and the other region is a tailored blank formed by another sheet metal having the different hardness.

The hardness adjusting process may include a process for heating a region to be low-hardness region 12 by using a laser, for example. By virtue of this, blank 10 is obtained, wherein the hardness of low-hardness region 12 of the blank is lower than the sheet metal.

Next, by bending or deforming low-hardness 12 of blank 10, product 20 as shown in FIG. 2 is formed (bending process). For example, the bending process may be carried out by press working using a press brake. For example, the press brake includes a lower mold (or a die) having a V-shaped groove corresponding to an outer shape of deformed portion 26 of product 20 of FIG. 2; and an upper mold (or a punch) having a front shape corresponding to the groove of the lower mold. The press brake is configured to position low-hardness region 12 of blank 10 between the lower and upper molds, move the upper mold toward the lower mold, and press low-hardness region 12 of blank 10 against the lower mold so as to deform blank 10. By using the press brake, column-shaped product 20 having a C-shaped cross-section as shown in FIG. 2 can be easily manufactured from blank 10.

A method for deforming low-hardness region 12 of blank 10 so as to form product 20 is not limited to the press working using the press brake, and various methods may be selected depending on the shape of product 20 and the material of blank 10, etc. For example, low-hardness region 12 of blank 10 may be deformed by a roll forming method.

Deformed portion 26 of product 20 is obtained by bending low-hardness region 12. In this regard, the strength of deformed portion 26 is increased due to work-hardening by the bending process. For example, when the hardness of low-hardness region 12 of used blank 10 is within a range from 30% to 70% of the hardness of high-hardness region 14 of blank 10, the hardness of deformed portion 26 of product 20 may be within a range from 40% to 80% of the hardness of high-hardness region 14 (i.e., a portion other than deformed portion 26).

This embodiment includes the hardness adjusting process for changing the hardness of sheet metal 11 so as to form blank 10 including high-hardness region 14 and low-hardness region 12; and the bending process for bending low-hardness region 12 of blank 10 so as to form product 20. Since low-hardness region 12 is deformed in the bending process, a crinkle or crack is prevented from being generated in deformed portion 26 (or low-hardness region 12) of product 20, and a springback is prevent from being generated in product 20.

It is preferable that a high-strength steel sheet having tensile strength of 980 MPa (corresponding to Vickers hardness of Hv 310) or more be used as the sheet metal. This is because such a steel sheet is economic and the predetermined high- and low-hardness regions can be easily and industrially formed.

The reason why the tensile strength is 980 MPa or more is because a low-strength steel sheet having tensile strength less than 980 MPa may be processed without using the present invention, and thus the present invention has few advantages. In fact, an upper limit of the tensile strength corresponds to a maximum strength of a steel sheet capable of being industrially produced, and thus the upper limit is not specified in particular. For example, the present invention can be applied to a steel sheet having tensile strength of 1700 MPa.

In the above embodiment, product 20 as shown in FIG. 2 is the channel-shaped member having the generally C-shaped cross-section, including bottom wall 22, and opposed side walls 24 vertically extending from both side edges of bottom wall 22. However, the product of invention is not limited to the shape in FIG. 2, and may have any shape as long as the shape is formed by the bending method of the invention. In particular, the number and shape of deformed portion 26 of product 20 are not limited to the example in FIG. 2. For example, the product may have a shape of a product 50 as shown in FIG. 5A.

Figure 5A:
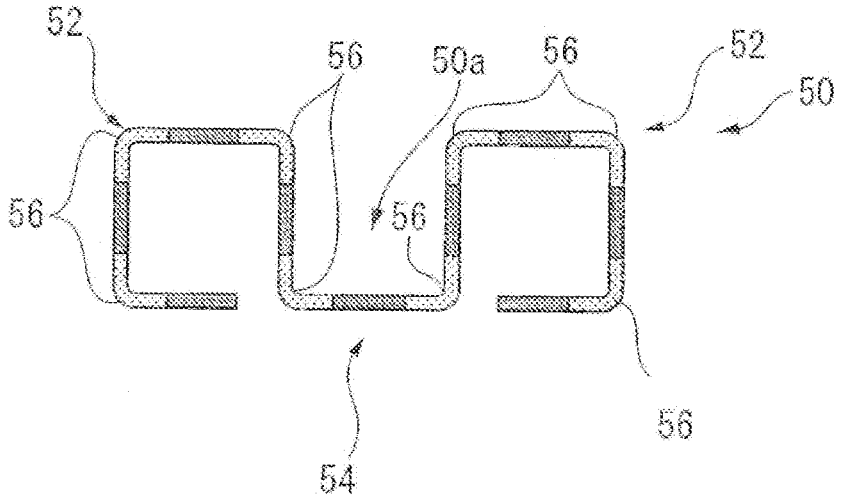
FIG. 5A is an end view of another example of a product manufactured by the bending method of the first embodiment of the invention.
Figure 5B:
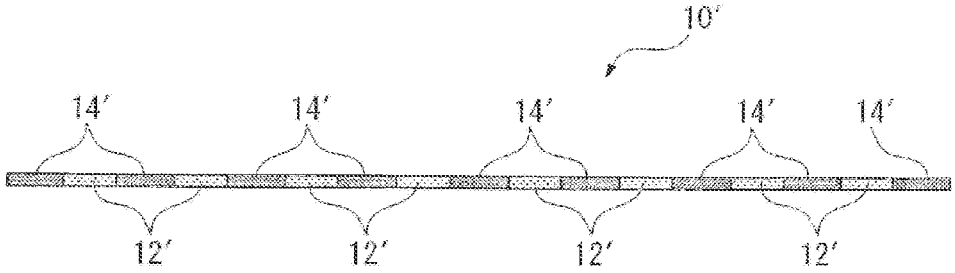
FIG. 5B is a schematic side view of a blank for manufacturing the product of FIG. 5A.

Product 50 as shown in FIG. 5A includes a pair of rectangular column portions 52 connected to a bottom wall or connecting portion 54, wherein a groove portion 50*a* extending in the longitudinal direction is formed between column portions 52. Similarly to blank 10 as shown in FIG. 1, a blank 10' for forming product 50 includes owe or more (eight in the example of FIG. 5B) low-hardness regions 12' and a plurality of (nine in the example of FIG. 5B) high-hardness regions 14', the regions being formed by hardness adjusting process as described above from a sheet metal of iron, iron alloy, aluminum or aluminum alloy. Although blank 10' of FIG. 5B is a rectangular sheet material similarly to blank 10 in FIG. 1, the shape and dimension of blank 10' may be variously determined depending on intended use, etc., of a product 50.

Figure 1:
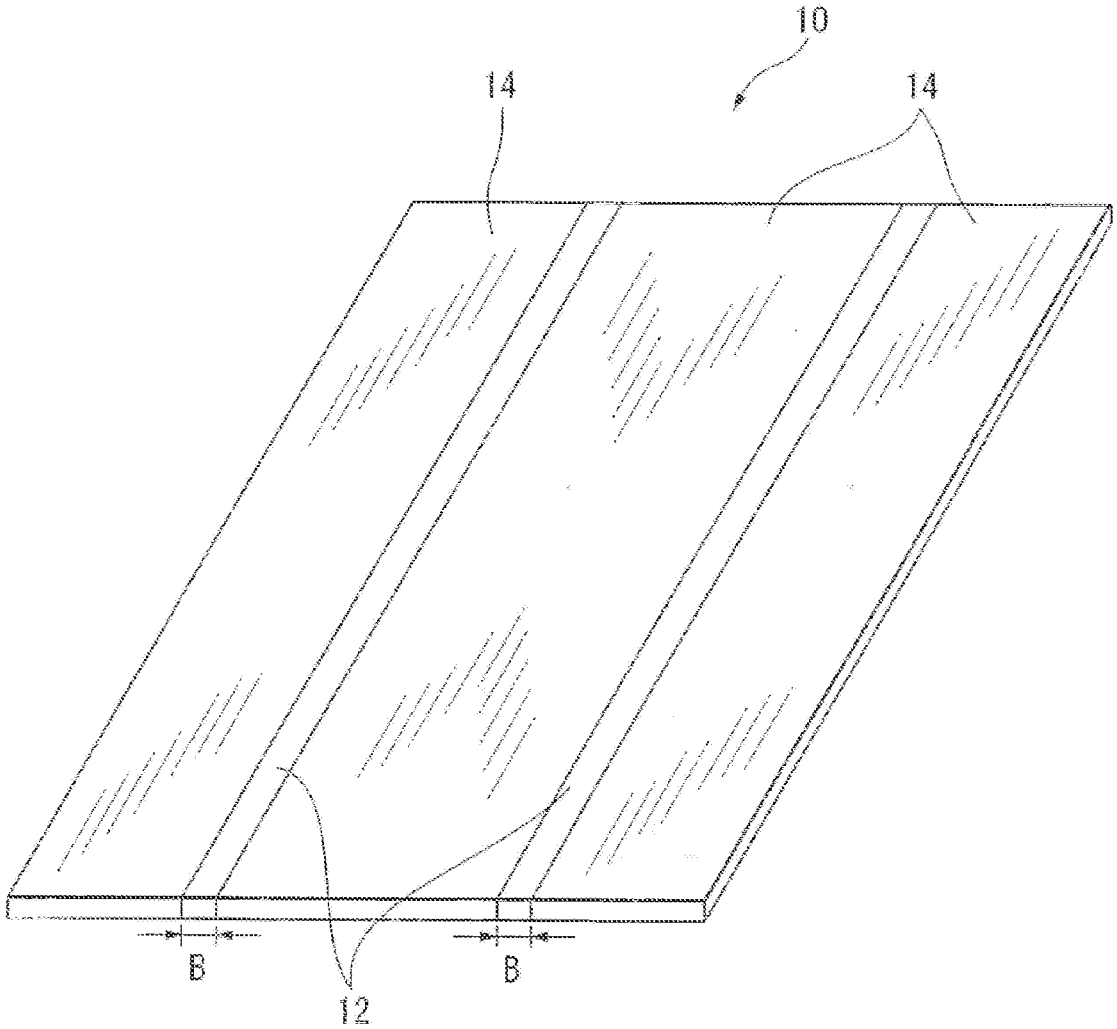
FIG. 1 is a schematic perspective view of a sheet metal according to a first embodiment of the present invention.

Similarly to product 20 of FIG. 1, product 50 of FIG. 5A may be manufactured by changing the hardness of the sheet metal so as to form blank 10' including high-hardness region 14' and low-hardness region 12' (the hardness adjusting process); and by bending low-hardness region 12' of blank 10' (the bending process). In addition, as shown in FIG. 5A, eight deformed portions 56, each having a predetermined bend radius, are formed in product 50. Low-hardness region 12' of blank 10' has the shape of eight bands extending in the longitudinal direction of blank 10' (or the direction perpendicular to a paper of FIG. 5B) so that a region to be deformed portions 56 of product 50 are included in low-hardness region 12'.

EXAMPLE

Hereinafter, examples of the present invention will be explained with reference to FIGS. 6 to 10B.

Figure 9:
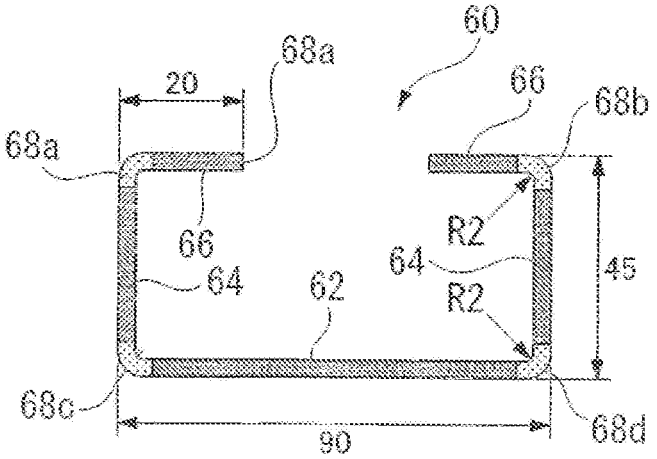
FIG. 9 is a schematic end view of a product manufactured from the blank of FIG. 7 by the processes of FIGS. 8A to 8D.

By the method as described above, a product 60 as shown in FIG. 9 was formed. In FIG. 9, a unit of length of numerical numbers is millimeters (mm). Product 60 of FIG. 9 is a channel-shaped member, including a bottom wall 62; opposed side walls 64 vertically extending from both side edges of bottom wall 62; and a pair of flange portions 66 extending inwardly from side walls 64 parallel to bottom wall 62, wherein an opening 60*a* is formed between flange portions 66. As shown in FIG. 9, product 60 has four deformed portions 68*a* to 68*d*, and a bend radius "R2" of each deformed portion is 2 mm.

Figure 6:
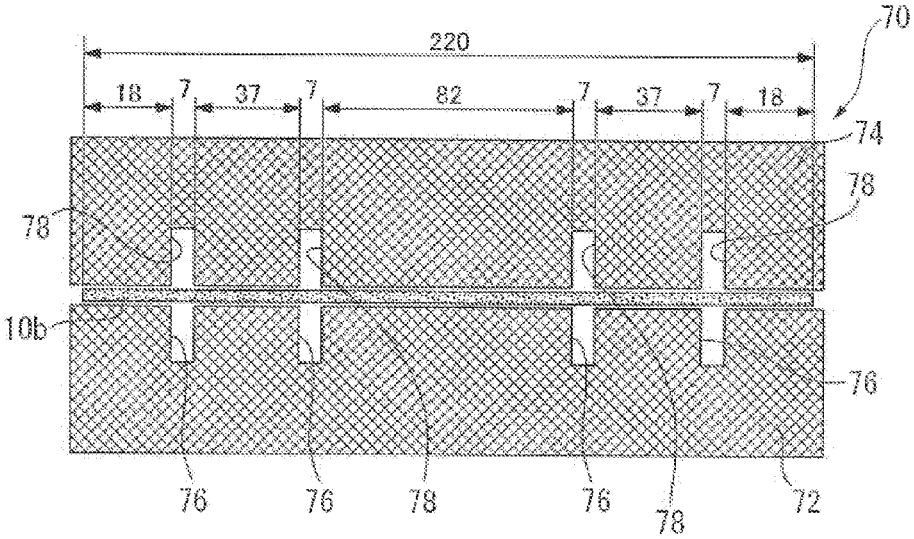
FIG. 6 is a schematic view of another example of a mold device used in hardness adjusting process of the bending method of the first embodiment of the invention.
Figure 7:
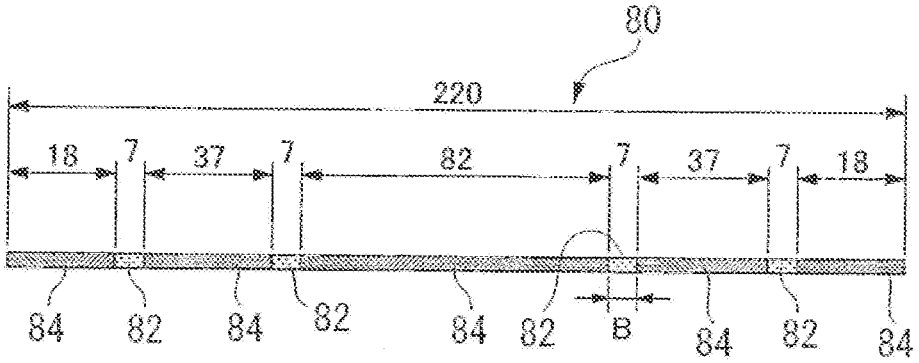
FIG. 7 is a schematic cross-sectional view of a blank manufactured by the mold device of FIG. 6.
Figure 8A:
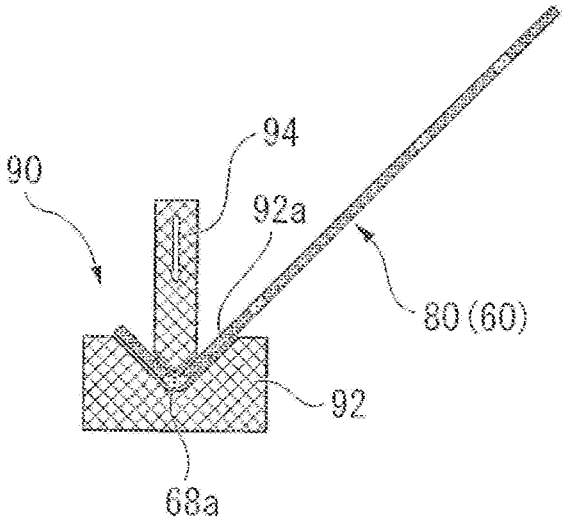
FIG. 8A is a schematic process chart for explaining an example of be riding process.
Figure 8B:
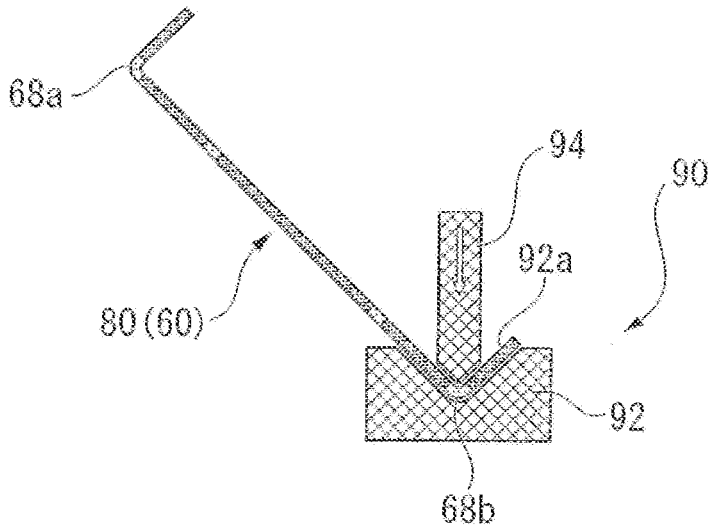
FIG. 8B is a schematic process chart for explaining an example of bending process.
Figure 8C:
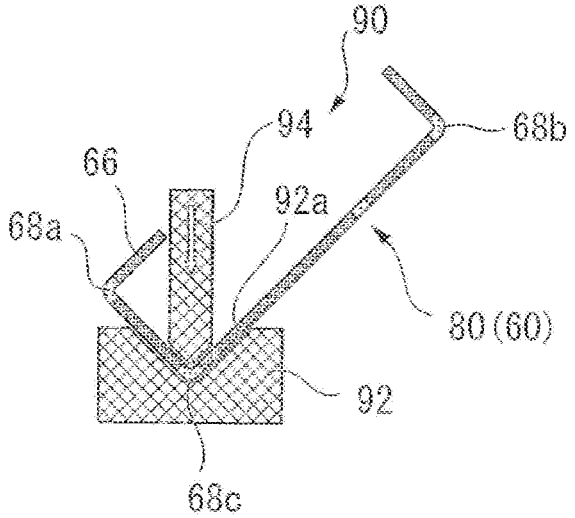
FIG. 8C is a schematic process chart for explaining an example of bending process.
Figure 8D:
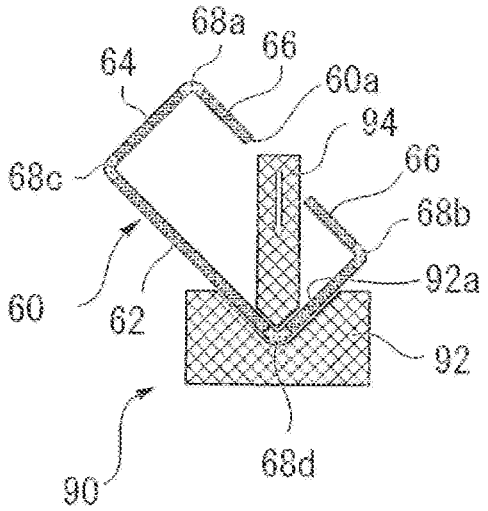
FIG. 8D is a schematic process chare for explaining an example of bending process.

In order to manufacture product 60 as shown in FIG. 9, rectangular sheet metals SM1 and SM2 each having a width of 220 mm, a length of 1200 mm, and a thickness of 1.2 mm, were prepared. Sheet metals SM1 and SM2 are high-strength steel plates having compositions as indicated in Table 1. Then, after sheet metals SM1 and SM2 were heated by means of a heating furnace to 900 degrees C. (the heating process), a portion to be a high-hardness region 84 of a blank 80 (FIG. 7) was quenched by using a mold devices 70 having a lower mold 72 and an upper mold 74 (schematically shown in FIG. 6) (the hardening process), whereby blank 80 was formed. A unit of length numerical numbers in FIGS. 6 and 7 is millimeters (mm). As shown in FIG. 7, width B of a low-hardness region 82 of blank 80 is 7 mm, and thus the width of each of grooves 76 and 78 of lower and upper molds 72 and 74 of mold device 70 is also 7 mm.

TABLE 1

| | C | Si | Mn | P | S | Cr | Al | B | Ti | Ac3 (° C.) |
|---|---|---|---|---|---|---|---|---|---|---|
| SM1 | 0.16 | 0.25 | 0.73 | 0.020 | 0.003 | 1.05 | 0.025 | 0.002 | 0.020 | 857 |
| SM2 | 0.22 | 0.22 | 1.29 | 0.020 | 0.003 | 0.21 | 0.040 | 0.002 | 0.024 | 827 |

In relation to example 1 (sheet metal SM1) and example 2 (sheet metal SM2) obtained as described above, an average hardness of high-hardness region 84 (Hvh) and an average hardness of low-hardness region 82 (Hvl) of blank 80 were measured, and a ratio of the hardness of the low-hardness region relative to the hardness of the high-hardness region (Hvl/Hvh×100%) was calculated. The result is indicated in Table 2.

TABLE 2

| | | Average hardness (Hv) | | |
|---|---|---|---|---|
| | Sheet metal | High-hardness region | Low-hardness region | Hardness ratio (%) |
| Inv. ex. 1 | SM1 | 412 | 276 | 67 |
| Inv. ex. 2 | SM2 | 501 | 336 | 67 |
| Comp. ex. 1 | SM1 | 411 | — | — |
| Comp. ex. 2 | SM2 | 503 | — | — |

Sheet metals SM1 and SM2 similar to examples 1 and 2 were prepared, and heated by means or a hearing furnace to 900 degrees C. (the heating process). After that, by using a mold (not shown), the entirety of the sheet metals were cooled under the same cooling condition as high-hardness region 84 of blank 80 in examples 1 and 2 (the hardening process). As a result, blanks of comparative examples 1 and 2 (sheet metals SM1 and SM2) were obtained, wherein the entirety of the blanks were constituted by the high-hardness region without including the low-hardness region. Table 2 indicates average hardness (Hvh) of comparative examples 1 and 2.

The tensile strength of the blanks of (sheet metals SM1 and SM2) of comparative examples 1 and 2 in Table 2 were 1360 MPa and 1690 MPa, respectively. From this, it can be estimated that the tensile strength of the high-hardness regions of the blanks (sheet meters SM1 and SM2) of examples 1 and 2 of the invention, having the same chemical compositions and the same average hardness as comparative examples 1 and 2, were generally equal to 1360 MPa and 1690 MPa, respectively, As indicated in Table 2, blank 80 of examples 1 and 2 of the invention includes high-hardness region 84 having the same average hardness (Hvh) as the blank of comparative examples 1 and 2, and low-hardness region 82 having average hardness (Hvl) lower than high-hardness region 84.

As indicated in Table 2, the hardness ratio (Hvl/Hvh× 100%) was 67% in both of examples 1 and 2. Further, as a measurement result, the tensile strength of the blank of comparative example 1 was 1200 MPa or more, and the tensile strength of the blank of comparative example 2 was 1500 MPa or more.

After that, as shown in FIGS. 8A to 8D, by bending each low-hardness region 82 of the blanks of examples 1 and 2 by means of a press brake, four deformed portions 68*a*, 68*b*, 68*c* and 68*d* (FIG. 9) were sequentially formed in channel-shaped product 60, whereby products P1 and P3 were obtained (the bending process).

In FIGS. 8A to 8D, press brake 90 includes a lower mold (or a die) 92 having a V-shaped groove 92*a* corresponding to an outer shape of each deformed portion 68*a*, 68*b*, 68*c* and 68*d* of product 60; and an upper mold (or a punch) 94 having a front shape corresponding to groove 92*a* of lower mold 92. One low-hardness region was selected from four low-hardness regions 82 of blank 80, and the selected region was positioned between lower mold 92 and upper mold 94. Then, upper mold 94 was downwardly moved toward lower mold 92 so as to press and bend low-hardness region 82 by lower and upper molds 92 and 94. Such operations were sequentially carried out in relation to other low-hardness regions 82.

By a bending process wherein low-hardness regions 82 of blank 80 of examples 1 and 2 were bent by means of a 21-stage roll forming machine, deformed portions 60 were sequentially formed, whereby products P2 and P4 were obtained (the bending process).

By a bending process wherein the blanks of comparative examples 1 and 2 were bent by means of a press brake similarly to the process for products P1 and P3, channel-shaped products P5 and P7 were manufactured. Further, by using the 21-stage roll forming machine as described above, products P6 and P8 were manufactured from the blanks of comparative examples 1 and 2.

In relation to products P1 to P8 obtained as such, a bending test was carried out, and a result thereof is indicated in Table 3.

TABLE 3

| Formed product No. | Blank | Sheet metal | Result of forming: Forming method | Result of forming: Corner crack | Result of bending test: Peak load P (kN) | Result of bending test: Corner crack | Result of bending test: Absorption energy E (J) |
|---|---|---|---|---|---|---|---|
| P1 | Inv. ex. 1 | SM1 | Press brake | No crack | 31.5 | No crack | 1205 |
| P2 | | | Roll forming | No crack | 31.7 | No crack | 1218 |
| P3 | Inv. ex. 2 | SM2 | Press brake | No crack | 37.9 | No crack | 1480 |
| P4 | | | Roll forming | No crack | 38.2 | No crack | 1485 |
| P5 | Comp. ex. 1 | SM1 | Press brake | No crack | 32.2 | Crack | 806 |
| P6 | | | Roll forming | No crack | 32.3 | Crack | 817 |
| P7 | Comp. ex. 2 | SM2 | Press brake | No crack | 39.0 | Crack | 859 |
| P8 | | | Roll forming | Crack | — | — | — |

Figure 10A:
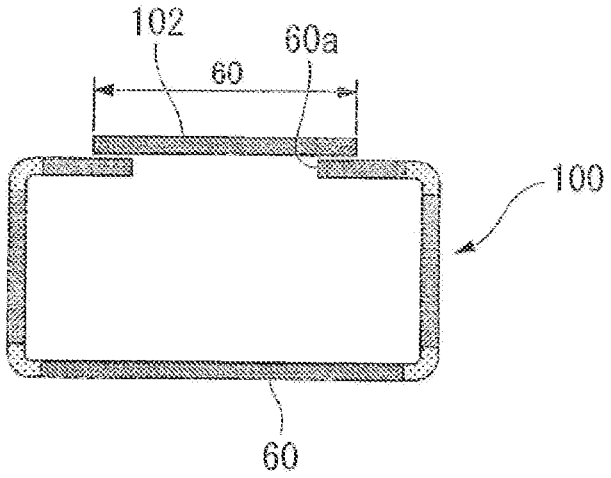
FIG. 10A is a schematic end view of a test piece for carrying out a bending test.

A test piece 100 as shown in FIG. 10A is constituted by a hollow member including product 60 and a steel plate 102 jointed to an opening 60*a* of product 60 by arc welding. The bending test was carried out by using products P1 to P8 as product 60. As steel plate 102, a sheet metal of the same material as the sheet metal for manufacturing products P1 to P7, and having a width of 60 mm, a length of 1200 mm, and a thickness of 1.2 mm, was prepared. The above heating process and hardening process were carried out in relation to the sheet metal so that the sheet metal had the hardness equivalent to high-hardness region 84.

Figure 10B:
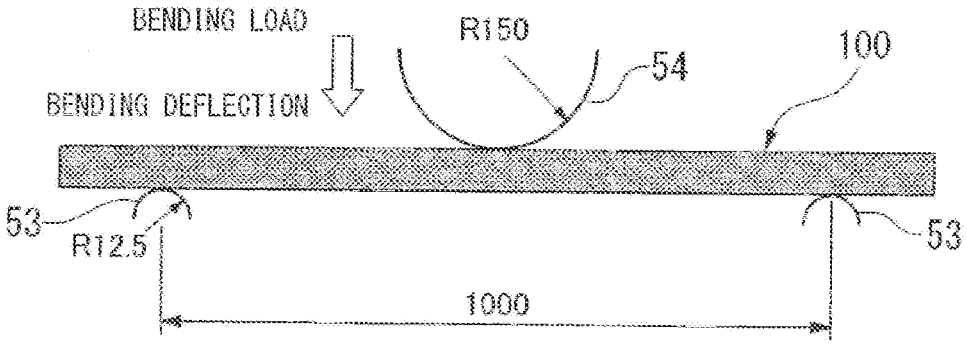
FIG. 10B is a schematic view for explaining a method of a bending test.

Next, tubular test piece 100 obtained as such was positioned so that steel plate 102 was directed downward, as shown in FIG. 10B, and was positioned so as to form a beam of test piece 100 having a span of 1000 mm between two fulcrum points 53, 53, each fulcrum point providing with a front end having hemispherical shape of a radius of 12.5 mm. Then, a three-point bending test was carried out by positioning a jig 54 having a hemispherical shape of a radius of 150 mm at the center of the beam, and peak load for maximum load) of the bending load and absorption energy to a bending deflection of 50 mm were determined.

In addition, in relation to products P1 to P8, the existence of a crack (or a corner crack) in deformed portions 68*a*, 68*b*, 68*c* and 68*d* were visually checked in the bending process and the bending test. The result was indicated in Table 3.

As indicated in Table 3, in products P1 to P4 using blank 80 of examples 1 and 2, the corner crack did not occur in the bending process and the bending test.

The peak load of products P1 to P3 was slightly lower than respective products P5 to P7 manufactured by using the sheet metal having the same compositions in the same method. On the other hand, the absorption energy of products P1 to P3 was significantly higher than respective products P5 to P7.

In products P5 to P7 using the blank of comparative examples 1 and 2, although the corner crack did not occur in the bending process, the corner crack occurred in the bending test.

Further, in product P8 using the blank of comparative example 2 having the tensile strength of 1500 MPa or more, the corner crack occurred in the bending process, and the bending test could not be carried out.

In addition, in order to manufacture product 60 as shown in FIG. 9, a sheet metal having a rectangular shape in a planar view, a width of 220 mm, a length of 1200 mm, and a thickness of 1.2 mm, was prepared. The sheet metal had a yield point (YP) of 742 MPa, tensile strength (TS) of MPa, and an elongation (EL) of 2.7%.

Next, by heating a region of the sheet metal to be low-hardness region 82 by means of a laser, the hardness of the sheet metal was changed so as to blank 80 of example 3 having high-hardness region 84 and low-hardness region 82 having the hardness lower than high-hardness region 84, as shown in FIG. 7 (the hardness adjusting process).

The laser welding was carried out by using a 5 kw YAG laser. Since a region having a width of about 2 mm is heated at a welding speed of 15 m/min by using the 5 kw YAG laser, low-hardness region 82 of 7 mm to 7 mm was formed by irradiating a laser in four rows at a 2 mm pitch.

Average hardness (Hv) of the blank of example 3 obtained as such was measured, similarly to the average hardness of blank 80 of example 1, and a result thereof is indicated Table 4.

TABLE 4

| | Average hardness (Hv): High-hardness region | Average hardness (Hv): Low-hardness region | Hardness ratio (%) |
|---|---|---|---|
| Inv. ex. 3 | 295 | 145 | 49 |
| Comp. ex. 3 | 297 | — | — |

By using the blank of example 3, a channel-shaped member or product P9 having the same shape as product 60 of FIG. 9 was manufactured, by means of a press brake, in the process similar to the process for manufacturing product P1.

By using the blank of example 3, a channel-shaped member or product P10 having the same shape as product 60 of FIG. 9 was manufactured, by means of a press brake, in the process similar to the process for manufacturing product P2.

Further, the sheet metal same as the sheet metal used to form the blank of example 3 is referred to as a blank of comparative example 3, and average hardness (Hv) of the blank of comparative example 3 was measured, similarly to the average hardness of the blank of example 3, and a result thereof is indicated Table 4.

By using the blank of comparative example 3, a channel-shaped member or product P11 having the same shape a product 60 of FIG. 9 was manufactured, by means of a press brake, in the process similar to the process for manufacturing product P1.

By using the blank of comparative example 3, a channel-shaped member or product P12 having the same shape as product 60 of FIG. 9 was manufactured, by means of a press brake, in the process similar to the process for manufacturing product P2.

In relation to products P9 to P12 obtained as such, a bending test was carried out, and a result thereof is indicated in Table 5. In addition, in relation to products P9 to P12, the existence of a crack (or a corner crack) in the deformed portions were visually checked in the bending process and the bending test similarly to product P1. the result was indicated in Table 3.

TABLE 5

| Formed | | Result of forming | | Result of bending test | | |
|---|---|---|---|---|---|---|
| | | | | Peak | | Absorption |
| product No. | Blank | Forming method | Corner crack | load P (kN) | Corner crack | energy E (J) |
| P9 | Inv. ex. 3 | Press brake | No crack | 19.1 | No crack | 755 |
| P10 | | Roll forming | No crack | 19.3 | No crack | 762 |
| P11 | Comp. ex. 3 | Press brake | No crack | 19.9 | Crack | 401 |
| P12 | | Roll forming | Crack | — | — | — |

As indicated in Table 5, in products P9 and P10 using the blank of example 3, the corner crack did not occur in the bending process and the bending test. The peak load of product P9 was slightly lower than product P11 manufactured by using the sheet metal having the same compositions in the same method. On the other hand, the absorption energy of product P9 was significantly higher than product P11.

On the other hand, the absorption energy of product P10 was 700 J or more, which was significantly higher than product P11 manufactured by using the sheet metal having the same compositions.

In product P11 manufactured from the blank of comparative example 3 by means of the press brake, although the corner crack did not occur in the bending process, the corner crack occurred in the bending test. Further, in product P12 manufactured from the blank of comparative example 3 in the roll forming, the corner crack occurred in the bending process, and the bending test could not be carried out.

Below, a second embodiment of the present invention will be explained while referring to the attached drawings.

A blank 110 exemplified in FIG. 11, to which the bending method for a sheet metal of the invention is applied, includes one or more (two in the example of FIG. 11) low-hardness regions 112 and a plurality of (three in the example of FIG. 1) high-hardness regions 114, the regions being formed by hardness adjusting process as described below from a sheet metal of iron, iron alloy, aluminum or aluminum alloy. Although blank 10 is a rectangular sheet material in FIG. 1, the shape and dimension of blank 10 may be variously determined depending on intended use, etc., of a product 20. Further, although low-hardness regions 12 of blank 10 extend parallel to a longitudinal direction, low-hardness regions 12 may be extend non-parallel depending on the shape and intended use of product 20. Blank 10 may be a continuous web withdrawn from a coil-shaped supply, for example, when a roll forming method is used. Unlike low-hardness region 12 of blank 10 of the first embodiment, each low-hardness region 112 extends from one side of blank 110 to a generally center in the thickness direction thereof, and does not reach the opposed side of the blank. As such, an objective region 116 to be processed having low-hardness region 112 and high-hardness region 114 is formed in a part of the sheet metal, wherein front and rear sides of objective region 116 have the different hardness. In addition, in the embodiment of FIG. 11, high-hardness region 114 includes three regions on one side including low-hardness region 112, while including one region on the other side.

The dimension of low-hardness region 112 of objective region 116 in the thickness direction of the sheet metal may be determined depending on the hardness and/or the thickness of the sheet metal, the shape and/or the production method of product 120, etc. In this regard, it is preferable that the dimension of low-hardness region 112 in the thickness direction be within a range from 35% to 65% of the thickness of the sheet metal, in order to obtain a remarkable effect due to forming objective region 116 basing the different hardness in the front and rear sides. In addition, although low-hardness regions 112 of blank 110 extend parallel to the longitudinal direction in the embodiment of FIG. 11, low-hardness regions 112 may extend non-parallel depending on the shape and intended use of product 120, etc.

Figure 11:
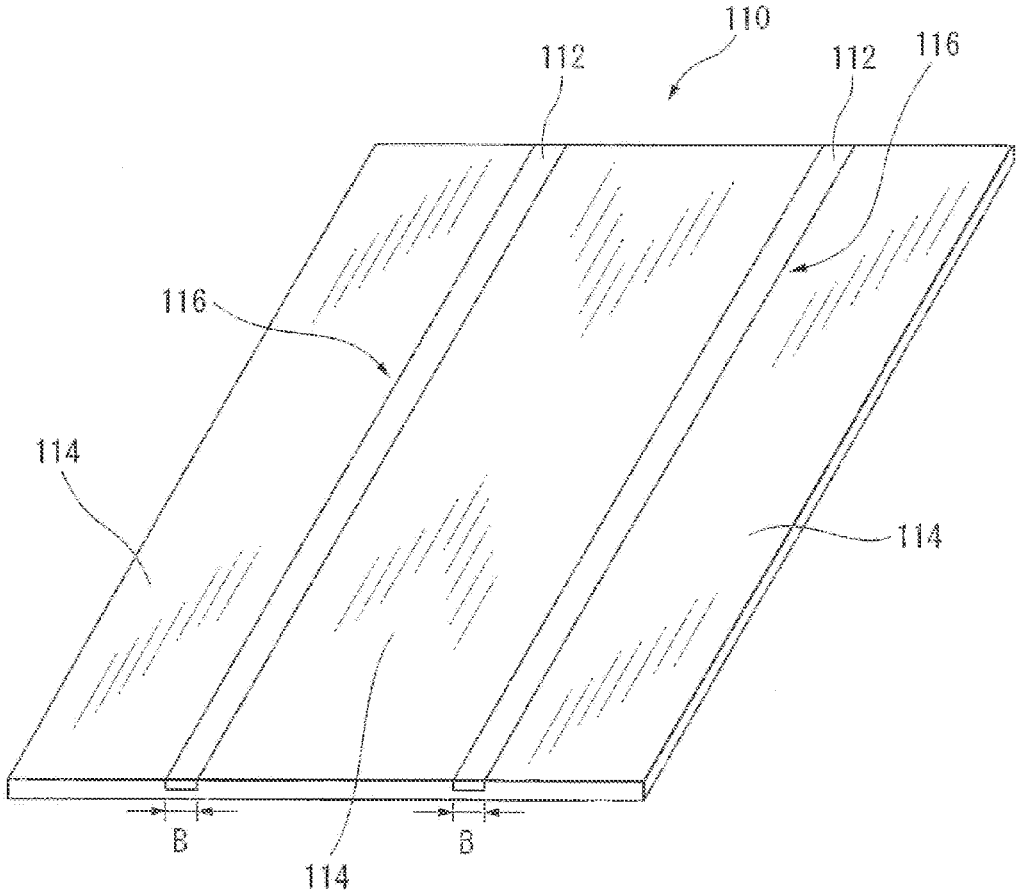
FIG. 11 is a schematic perspective view of a sheet metal according to a second embodiment of the present invention.

Although blank 110 is a rectangular sheet material in FIG. 11, the shape and dimension of blank 110 may be variously determined, depending on intended use, etc., of a product 120. Further, blank 110 may be a continuous web withdrawn from a coil-shaped supply, for example, when a roll forming method, is used.

In this embodiment, the hardness of high-hardness region 114 on the rear side of objective region 116 is the same as the hardness of a region other than objective region 116. However, the hardness of high-hardness region 114 on the rear side of objective region 116 may be different from the hardness of the region other than objective region 116, as long as the hardness of high-hardness region 114 on the rear side of objective region 116 is higher than low-hardness region 112. Further, the hardness of the region other than objective region 116 may be the same as the hardness of the front side or the rear side of objective region 116, otherwise, may be different from both the front side and the rear side.

Figure 12:
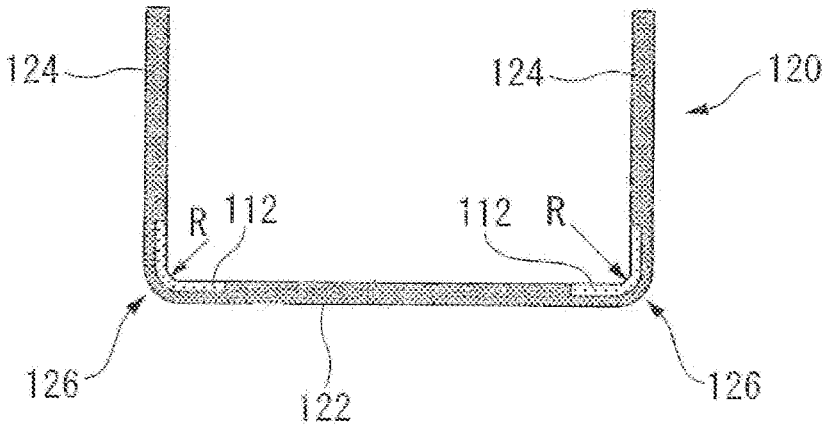
FIG. 12 is an end view of an example of a product manufactured from the sheet metal of FIG. 11 by a bending method of the second embodiment of the invention.

Similarly to the first embodiment, Blank 110 is bent along objective region 116, by a roll forming machine or press working using a press brake, and formed as channel-shaped product 120 having a C-shaped or cup-shaped cross-section, as shown in FIG. 12. In FIG. 12, product 120 is a channel-shaped member having a generally C-shaped cross-section, including a bottom wall 122, and opposed side walls 124 vertically extending from both side edges of bottom wall 122. Product 120 has two deformed portions or edge portions 126, which are formed from objective regions 116 and extend in the longitudinal direction. Each deformed portion or edge portion 126 has a bend radius "R." In addition, in product 120, edge portions 126 of blank 110 are bent in the same direction with respect to one side of blank 110 (the upward direction in FIGS. 11 and 12), so that all of an inside region of deformed portion 126 of product 120 in FIG. 12 forms a surface of objective region 116 of FIG. 11.

A width "B" of low-hardness region 112 may be determined depending on bend radius R of deformed portion 126 of product 120. Far example, as shown in FIG. 12, when deformed portion 126 of product 120 has a band-shape which is deformed so as to have constant bend radius R, it is preferable that width B of low-hardness region 112 be 0.5πR to 1.5πR, as shown in FIGS. 11 and 12. By virtue of low-hardness region 112 having width B within this range, product 120 may have sufficient strength and workability of blank 110 is effectively improved in bending process.

In order that blank 110 has improved workability while having sufficient strength, it is preferable that the hardness of low-hardness region 112 be within a range from 30% to 80% of the hardness of high-hardness region 114. When the hardness of low-hardness region 112 is too low, the strength of product 120 is insufficient even when the hardness of high-hardness region 114 is increased. On the other hand, when the hardness of low-hardness region 112 is too high, the workability in the bending process is insufficient when the hardness of high-hardness region 114 is high.

In the preferred embodiment of the invention, in the hardness adjusting process, blank 110 is formed by (1) changing the hardness of the entirety of the sheet metal so as to form objective region 116 to be processed; or (2) changing the hardness of a part region of the sheet metal in the thickness direction so as to form one or more low-hardness regions 112 in the sheet metal.

A method for forming blank 110 by changing the hardness of the entirety of the sheet metal, for example, includes a heating process for heating the entirety of the sheet metal by means of a heating furnace (not shown) or another heating device; and a hardening process for quenching only a region to be high-hardness region 114 of the heated sheet metal. The hardening process may be carried out, for example, by cooling only the region to be high-hardness region 114 by using a mold.

Figure 13:
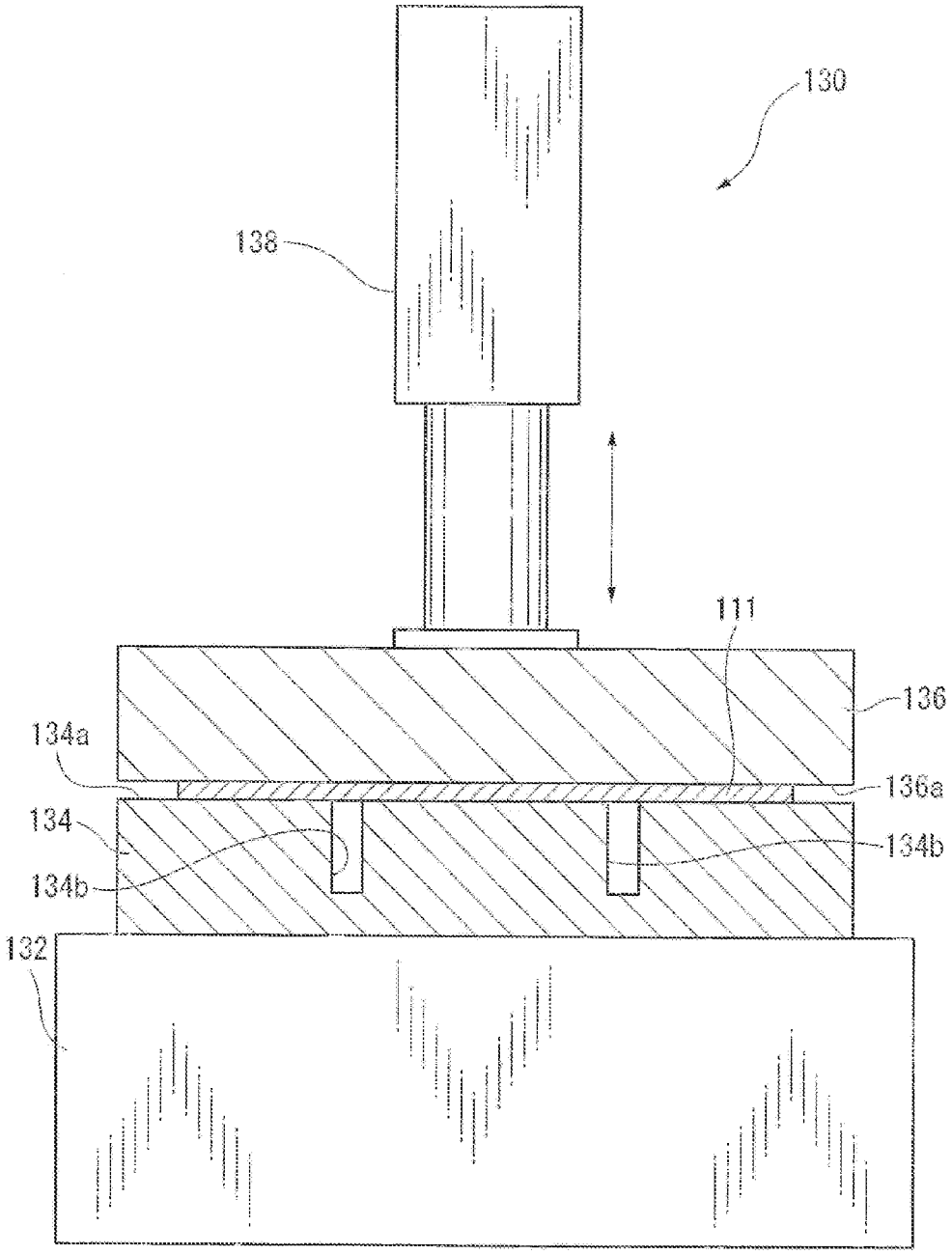
FIG. 13 is a schematic view of an example of a mold device used in hardness adjusting process of the bending method of the second embodiment for manufacturing the sheet metal of FIG. 11.

FIG. 13 shows a mold device 130 as an example of the cooling device for carrying out the hardening process of the second embodiment. Mold device 130 includes a bed 132 fixed to a floor of a factory, etc.; a lower mold 134 fixed to an upper surface of bed 132; and an upper mold 136 configured to be moved in the vertical direction closer to or away from lower mold 134 by means of a ram or a suitable drive unit 138. Sheet metal 111 is positioned between lower mold 131 and upper mold 136. Lower and upper molds 134 and 136 have operating surfaces 134*a* and 136*a* opposed to each other, respectively. On operating surface 134*a* of lower mold 134, a groove portion 134*b* is formed, at a position corresponding to low-hardness region 112 of sheet metal 111 after the hardening process.

First, sheet metal 111 is transferred from the heating furnace or heating device to mold device 130, after being heated in the heating process, and is positioned between lower and upper molds 134 and 136. Then, upper mold 136 is moved toward lower mold 134 by means of drive unit 138 so that operating surfaces 134*a* and 136*a* of lower and upper molds 134 and 136 come into contact with sheet metal 111. In sheet metal 111, only a portion, which contacts operating surfaces 134*a* and 136*a* of lower and upper molds 134 and 136, is rapidly cooled and hardened. In this regard, a portion of sheet metal 111, which faces groove portion 134*b* of lower mold 134, is not rapidly cooled by lower mold 134. As such, the portion of sheet metal 111, which faces groove portion 134*b* lower mold 134, is gradually cooled and becomes low-hardness region 112. On the other hand, the portion, which contacts operating surfaces 134*a* and 136*a* of lower and upper molds 134 and 136, is rapidly cooled and becomes high-hardness region 114, whereby blank 110 is formed.

Figure 14:
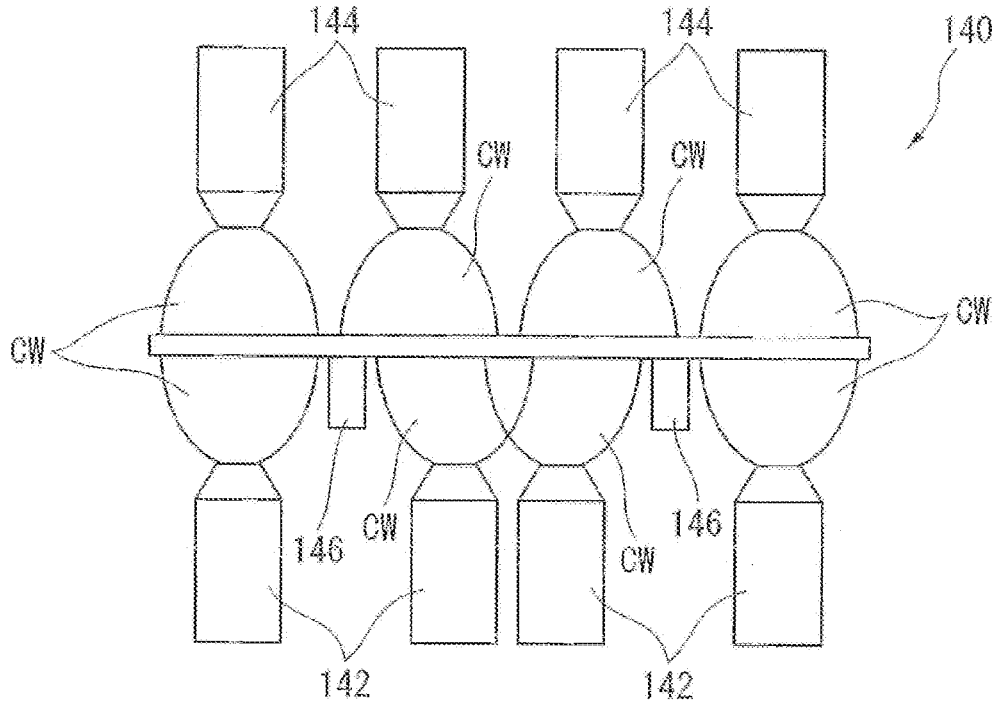
FIG. 14 is a schematic view of an example of a water-cooling device used in hardness adjusting process of the bending method of the second embodiment for manufacturing the sheet metal of FIG. 11.

Alternatively, the hardening process may be a process for selectively water-cooling only a region to be high-hardness region 114 of the sheet metal, for example, as shown in FIG. 14. FIG. 14 shows a water-cooling device 140 as an example of the cooling device for carrying out the hardening process of the invention. Water cooling device 140 includes a plurality of first (or lower) nozzles 142 which are arranged so as to face one side of sheet metal (or a lower surface of sheet metal 111 in FIG. 14); a plurality of second (or upper) nozzles 144 which are arranged so as to face the opposed side of sheet metal (or an upper surface of sheet metal 111 in FIG. 14), wherein cooling water CW can be supplied to the sides of sheet metal 111. Lower nozzles 142 and upper nozzles 144 are positioned so as to face a portion of sheet metal 111 which becomes be high-hardness region 114 after the hardening process. In particular, in this embodiment, upper nozzles 144 are positioned so as to supply cooling water CW to the front side of sheet metal 111. In order to prevent a portion of sheet metal 111, which becomes low-hardness region 112 after the hardening process, from being wetted with cooling water CW, water cooling device 140 may have a lower masking member 146, which is positioned to cover the portion of sheet metal 111 which becomes low-hardness region 112 after the hardening process. Lower masking member 146 may have a drive unit such as a hydraulic cylinder (not shown) for moving the masking member closer to or away from sheet metal 111. Further, lower masking member 146 may function as a retainer for correctly positioning and holding sheet metal 111 relative to lower and upper nozzles 142 and 144. Alternatively, water cooling device 140 may have another clamper for correctly positioning and holding sheet metal 111 relative to lower and upper nozzles 142 and 144.

First, sheet metal 111 is transferred from the heating furnace or heating device to water cooling device 140, after being heated in the heating process, and is positioned between lower and upper nozzles 142 and 144. In this regard, lower masking member 146 may be used as the retainer for correctly positioning and holding sheet metal 111 relative to lower and upper nozzles 142 and 144. Alternatively, as described above, another clamper (not shown) may be used for correctly positioning and holding sheet metal 111 relative to lower and upper nozzles 142 and 144. Then, cooling water CW is supplied from lower and upper nozzles 142 and 144 to a portion of sheet metal 111, which becomes high-hardness region 114 after the hardening process, so that this portion is rapidly cooled and hardened. In this regard, by using lower and upper masking members 146 and 148, a portion of sheet metal 111, which becomes low-hardness region 112 after the hardening process, is prevented from being wetted by cooling water CW and from being rapidly cooled. As such, the portion of sheet metal 111, which faces lower masking member 146, is gradually cooled and becomes low-hardness region 112, and the other portion is rapidly cooled and becomes high-hardness region 114, whereby blank 110 is formed.

Figure 15:
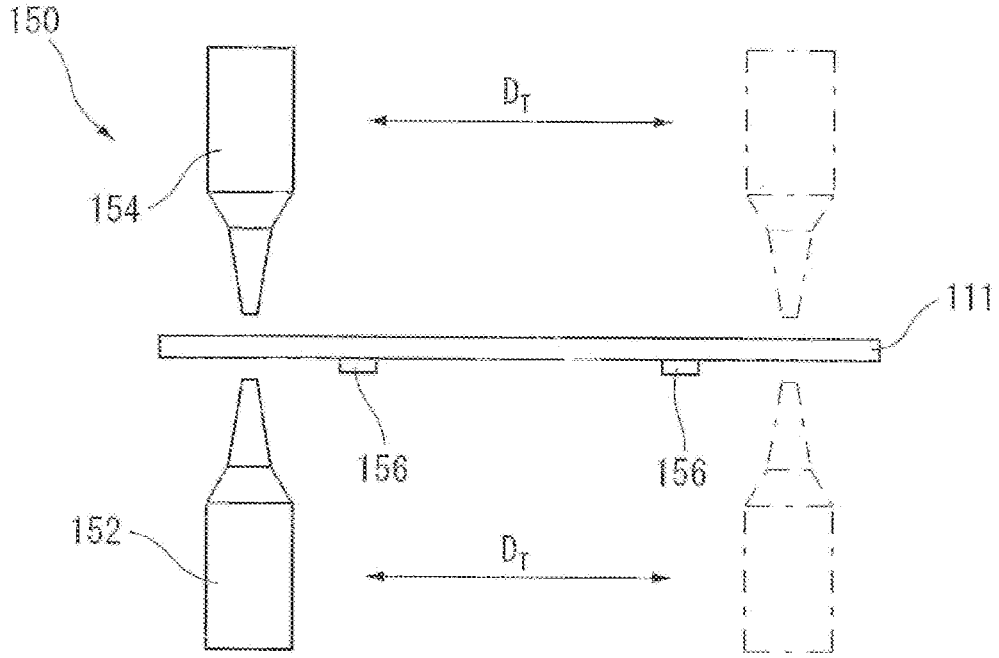
FIG. 15 is a schematic view of an example of a blasting machine used in hardness adjusting process of the bending method of the second embodiment for manufacturing the sheet metal of FIG. 11.

The hardness adjusting process in this embodiment may include a shot peening process wherein shots collide with at least the side of objective region 116 opposed to low-hardness region 112 of sheet metal 111. FIG. 15 shows a blasting machine 150 for carrying out the shot peening. Blasting machine 150 includes a plurality of first (or lower)

nozzles 152 which are arranged so as to face one side of sheet metal (or a lower surface of sheet metal 111 in FIG. 15); a plurality of second (or upper) nozzles 154 which are arranged so as to face the opposed side of sheet metal (or an upper surface of sheet metal 111 in FIG. 15), wherein shots (particles of steel, glass, ceramic or plastic) can be projected onto the sides of sheet metal 111. Preferably, blasting machine 150 may have a masking member 154, which is positioned to cover the portion of sheet metal 111 which becomes low-hardness region 112 after the shot peening process, whereby shots can be selectively projected onto only a region to be high-hardness region 114 (other than the region to be low-hardness region 112) in sheet metal 111. By virtue of this, the side having higher hardness (or high-hardness region 114) of objective region 116, to which the shots are projected, is formed, as shown in FIG. 15, and blank 110 can be obtained wherein the hardness of high-hardness region 111 of objective region 116 is the same as the sheet metal.

In this regard, by projecting cast-iron shots of 170 to 280 mesh (F-S170~280/JIS G5903) onto sheet metal 111 by means of an impeller-type blasting machine, the sheet metal can be sufficiently plastically deformed, whereby a desired hardness of the sheet metal may be obtained. In order to generate sufficient work-hardening in the depth direction of sheet metal 111 without generating a crack on the surface of sheet metal 111, it is desirable to use spherical cast-iron shots having Vickers hardness (Hv) of 650 or more. When cast-iron shots of less than 170 mesh are used, a fine crack, having the length of several micrometers to several tens of micrometers on the surface of the sheet metal, may be formed, due to the small curvature of the shot. On the other hand, when cast-iron shots or more than 280 mesh are used, the sheet metal cannot be sufficiently plastically deformed due to the large curvature of the shot. Therefore, it is preferable that the cast-iron shots of 170 to 230 mesh be used and projected by means of a mechanical impeller-type blasting machine capable of applying kinetic energy to the shots.

The hardness adjusting process may include a process for heating a region to be low-hardness region 112 by using a laser, from the side of sheet metal 111 on which low-hardness region 112 exists. In this case, the region heated by the laser become low-harness region 112, and the other region becomes high-hardness region 114.

The hardness adjusting process may include a process for carbonizing or nitriding a part of sheet metal 111 so as to form high-hardness region 114.

Next, by bending blank 110 so that low-hardness is positioned inside objective region 116 to be processed, product 120 as shown in FIG. 12 is formed (bending process). For example, the bending process may be carried out by press working using a press brake. For example, the press brake includes a lower mold (or a die) having a V-shaped groove corresponding to an outer shape of deformed portion 126 of product 120 of FIG. 12; and an upper mold (or a punch) having a front shape corresponding to the groove of the lower mold. The press brake is configured to position low-hardness region 112 of blank 110 between the lower and upper molds, move the upper mold toward the lower mold, and press low-hardness region 112 of blank 110 against the lower mold so as to deform blank 110. By using the press brake, column-shaped product 120 having a C-shaped cross-section as shown in FIG. 12 can be easily manufactured from blank 110.

A method for deforming low-hardness region 112 of blank 110 so as to form product 120 is not limited to the press working using the press brake, and various methods may be selected depending on the shape of product 120 and the material of blank 110, etc. For example, low-hardness region 112 of blank 110 may be deformed by means of a roll forming machine.

Deformed portion 126 of product 120 includes low-hardness region 112. In this regard, the strength of low-hardness region 112 is increased due to work-hardening by the bending process. For example, when the hardness of low-hardness region 112 of used blank 110 is within a range from 30% to 70% of the hardness of high-hardness region 114 of blank 110, the hardness of low-hardness region 112 in deformed portion 126 of product 120 may be within a range from 40% to 85% of the hardness of high-hardness region 114 other than deformed portion 126.

This embodiment includes the hardness adjusting process for changing the hardness of sheet metal 111 in the thickness direction thereof so as to form blank 110 partially including objective region 116 to be processed having the different hardness in the front and rear sides thereof; and the bending process for bending blank 110 so as to form product 120 wherein the side having lower hardness (or low-hardness region 112) is inside objective region 116. Since objective region 116 including low-hardness region 112 is deformed in the bending process, a crinkle or crack is prevented from being generated in deformed portion 126 (or low-hardness region 112) of product 120, and a springback is prevent from being generated in product 120. Further, product 120 has high strength, since a crack is unlikely to be generated in deformed portion 126 when load is applied to product 120.

It is preferable that a high-strength steel sheet having tensile strength of 980 MPa (corresponding to Vickers hardness of Hv 310) or more be used as the sheet metal. This is because such a steel sheet is economic and the predetermined high- and low-hardness regions can be easily and industrially formed.

The reason why the tensile strength is 980 MPa or more is because a low-strength steel sheet having tensile strength less than 980 MPa may be processed without using the present invention, and thus the present invention has few advantages. In fact, an upper limit of the tensile strength corresponds to a maximum strength of a steel sheet capable of being industrially produced, and thus the upper limit is not specified in particular. For example, the present invention can be applied to a steel sheet having tensile strength of 1700 MPa.

In the above embodiment, product 120 as shown in FIG. 12 is the channel-shaped member having the generally C-shaped cross-section, including bottom wall 122, and opposed side walls 124 vertically extending from both side edges of bottom wall 122. However, the product of invention is not limited to such a shape of FIG. 12, and may have any shape as long as the shape is formed by the bending method of the invention. In particular, the number and shape of deformed portion 126 of product 120 are not limited to the example of FIG. 12. For example, the product may have a shape of a product 160 as shown in FIG. 16A.

Figure 16A:
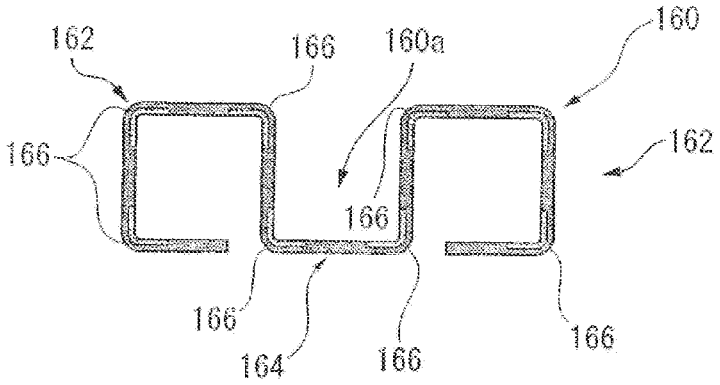
FIG. 16A is an end view of another example of a product manufactured by the bending method of the second embodiment of the invention.
Figure 16B:
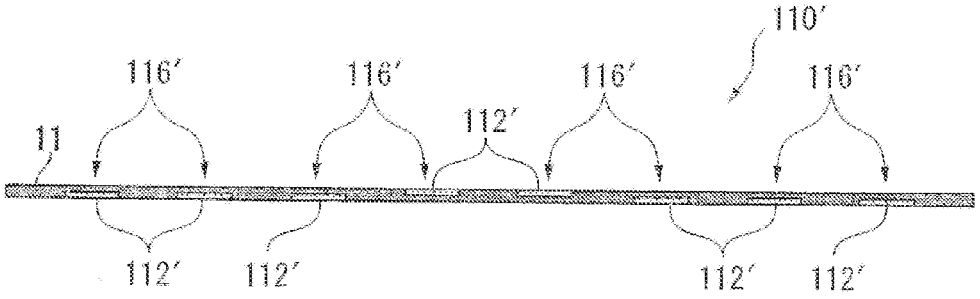
FIG. 16B is a schematic side view of a blank for manufacturing the produce of FIG. 16A.

Product 160 as shown in FIG. 16A includes a pair of rectangular column portions 162 connected to a bottom wall or connecting portion 164, wherein a groove portion 160*a* extending in the longitudinal direction is formed between column portions 162. Similarly to blank 110 as shown in FIG. 11, a blank 110' for forming product 160 includes one or more (eight in the example of FIG. 16B) low-hardness regions 112' and a high-hardness regions 114' corresponding to a region other than low-hardness regions 112', the regions being formed by hardness adjusting process as described above from a sheet metal of iron, iron alloy, aluminum or aluminum alloy. Although blank 110' of FIG. 16B is a rectangular sheet material similarly to blank 110 in FIG. 11, the shape and dimension of blank 110' may be variously determined depending on intended use, etc., of a product 160. In addition, in blank 110' of FIG. 16B, low-hardness regions 112' are formed on the both sides (upper and lower sides of FIG. 16B) of blank 110'.

Similarly to product 120 of FIG. 11, product 160 of FIG. 16A may be manufactured by changing the hardness of the sheet metal so as to form blank 110' including high-hardness region 114' and low-hardness region 112' (the hardness adjusting process); and by bending an objective region to be processed 116' including low-hardness region 112' and high-hardness region 114' of blank 110' (the bending process). In addition, as shown in FIG. 16A, eight deformed portions 166, each having a predetermined bend radius, are formed in product 160. Low-hardness region 112' of blank 110' has the shape of eight bands extending in the longitudinal direction of blank 110' (or the direction perpendicular to a paper of FIG. 16B) so that a region to be deformed portions 166 of product 160 are included in low-hardness region 112'.

Figure 17A:
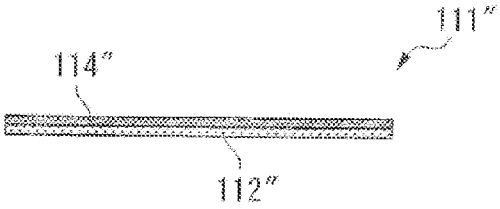
FIG. 17A is a side view of an example of a sheet metal wherein an entirety thereof corresponds to an objective region to be processed.

In FIGS. 11 and 16A, blanks 110 and 110' include objective regions 116 and 116' having the different hardness in the front and rear sides thereof, respectively, the objective regions being formed by changing the hardness of sheet metals 111 and 111' in the thickness direction thereof so that low-hardness regions 112 and 112' are formed in a part of the sheet metals, respectively. However, the present, invention is not limited to as such. For example, as shown in FIG. 17A, an objective region 116" to be processed may be formed over the entirety of a blank 110".

Figure 17B:
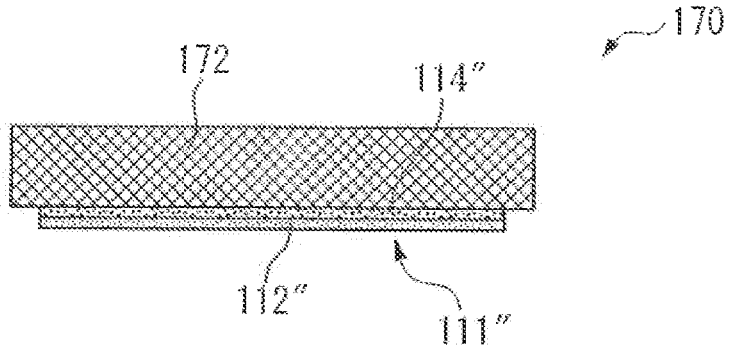
FIG. 17B is a schematic view for explaining hardness adjusting process of the bending method according to the second embodiment of the invention, wherein the sheet metal of FIG. 17A is manufactured by using a mold device.

In order to form blank 110" having objective region 116" extending over the entirety of the blank, the hardening process may be a process for coding the entirety of one side of the sheet metal by using a mold. Concretely, as exemplified in FIG. 17B, for example, a mold device 170 including an upper mold 172 may be prepared, wherein upper mold 172 has a planar shape corresponding to a planar shape of sheet metal 111". After heating sheet metal 111" by means of a heating furnace, etc., upper mold 172 of mold device 170 contacts the entirety of one side of the sheet metal to be high-hardness region 114" so as to cool the region, whereby the side contacting upper mold 172 becomes high-hardness region 114" and the opposed side becomes low-hardness region 112".

Figure 17C:
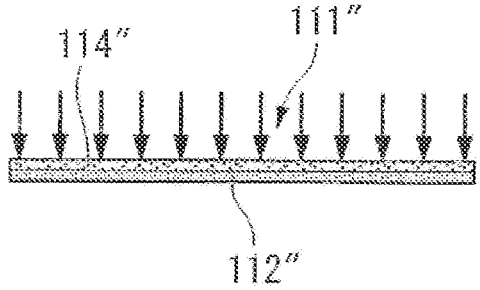
FIG. 17C is a schematic view for explaining hardness adjusting process of the bending method according to the second embodiment of the invention, wherein the sheet metal of FIG. 17A is manufactured by using a water-cooling device.

Alternatively, as exemplified in FIG. 17C, the hardening process may be a process for water-cooling the entirety of one side (or an upper surface in FIG. 17C) of sheet metal 111".

Figure 17D:
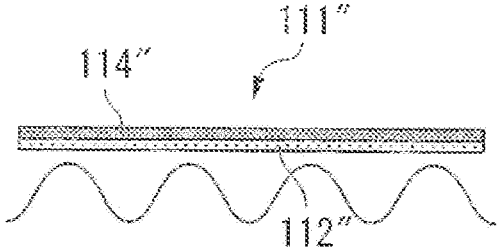
FIG. 17D is a schematic view for explaining hardness adjusting process of the bending method according to the second embodiment of the invention, wherein the sheet metal of FIG. 17A is manufactured by using a laser device.

As shown in FIG. 17D, a process, for heating the entirety of one side of sheet metal 111" to be low-hardness region 112" by using a laser, may be carried out. By using the method of FIG. 17D blank 111", including low-hardness region 112" having lower hardness than sheet metal 111" and high-hardness region 114" having the same hardness as sheet metal 111", is obtained.

The other methods for forming objective region 116" extending over the entirety of blank 111" may include: a shot peening process for projecting shots onto one side of sheet metal 111"; a process for carbonizing or nitriding one side of sheet metal 111"; and a process for overlapping and rolling a high-hardness sheet metal and a low-hardness sheet metal so as to form a multi-layer sheet, (not shown).

EXAMPLE

Hereinafter, examples of the present invention will be explained with reference to FIGS. 18A to 21B.

Figure 20:
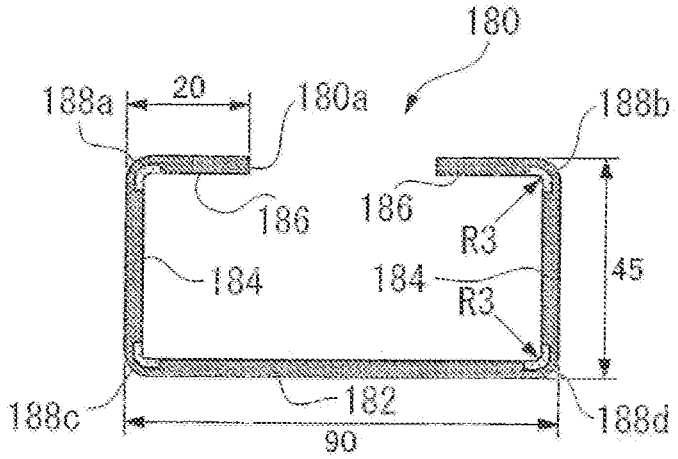
FIG. 20 is a schematic end view of a product manufactured from the blank of FIG. 7 by the processes of FIGS. 19A to 19D.

By the method as described above, a product 180 as shown in FIG. 20 was formed. In FIG. 20, a unit of length of numerical numbers is millimeters (mm). Product 180 of FIG. 20 is a channel-shaped member, including a bottom wall 182; opposed side walls 184 vertically extending from both side edges of bottom wall 182; and a pair of flange portions 186 extending inwardly from side walls 184 parallel to bottom wall 182, wherein an opening 180*a* is formed between flange portions 186. As shown in FIG. 20, product 180 has four deformed portions 188*a* to 188*d*, and a bend radius "R3" of each deformed portion is 2 mm.

In order to manufacture product 180 as shown in FIG. 20, rectangular sheet metal SM2 having a width of 220 mm, a length of 1200 mm, and a thickness of 1.2 mm, were prepared (see Table 1). Then, after sheet metal SM2 was heated by means of a heating furnace to 900 degrees C. (the heating process), a portion to be a high-hardness region 194 of a blank 190 (FIG. 18B) was quenched by using a mold device 200 having a lower mold 202 and an upper mold 204 (schematically shown in FIG. 18A) (the hardening process), whereby blank 190 was formed. By means of mold device 200, in sheet metal SM2, a portion facing groove portion 206 is gradually cooled (not cooled by upper mold 204) and becomes low-hardness region 192, and the other portion is rapidly cooled by means of lower and upper molds 202 and 204 and becomes high-hardness region 194.

When a contact time between the sheet metal and molds 202, 204 is too short, the sheet metal is not hardened. On the other hand, when the contact time is too long, the non-contact region facing groove portion 206 of upper mold 204 is also hardened. Therefore, in example 4, the contact time between the sheet metal and molds 202, 204 was determined to 5 seconds, in view of the thickness of the sheet metal, the planar shape of the region to be low-hardness region 192, and the dimension of low-hardness region 192 in the thickness direction of the sheet metal, etc.

Figure 18A:
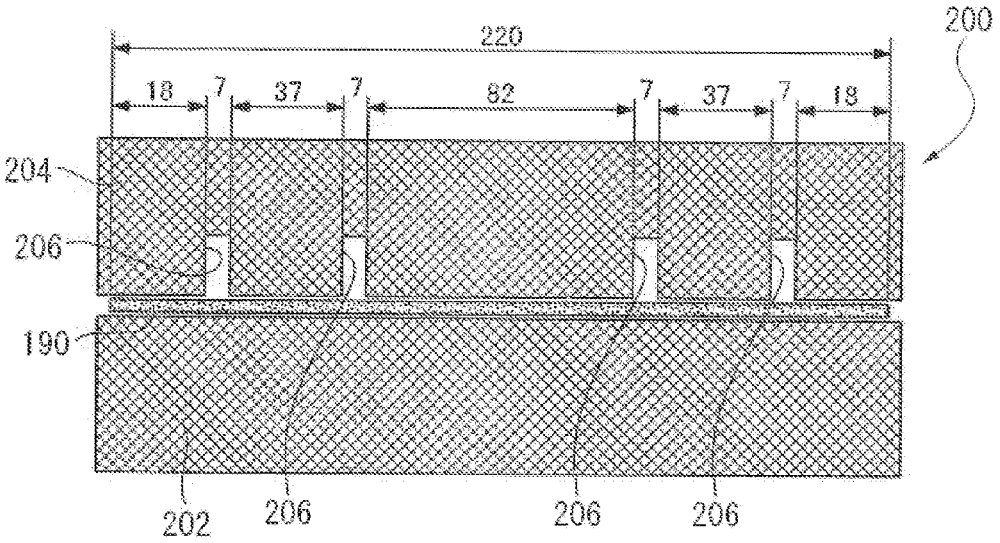
FIG. 18A is a schematic view of another example of a mold device used in hardness adjusting process of the bending method of the second embodiment of the invention.
Figure 18B:
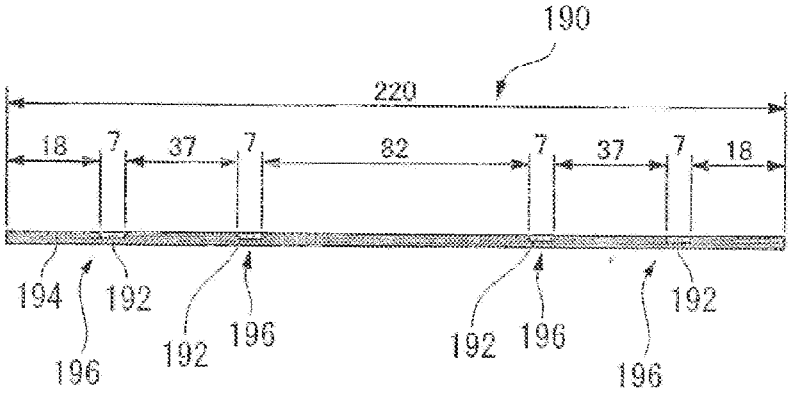
FIG. 18B is a schematic cross-sectional view of a blank manufactured by the mold device of FIG. 18A.
Figure 19A:
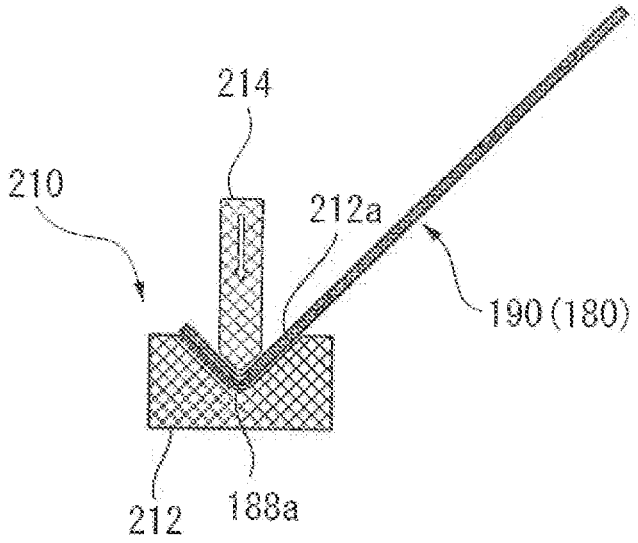
FIG. 19A is a schematic process chart for explaining an example of bending process.
Figure 19B:
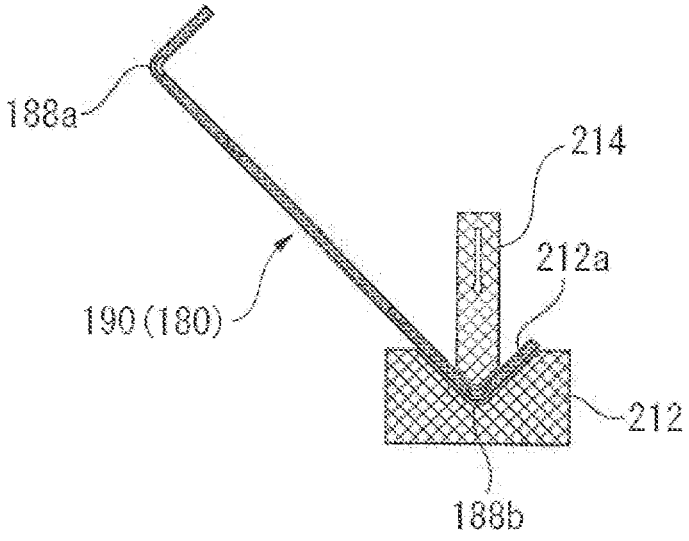
FIG. 19B is a schematic process chart for explaining an example of bending process.
Figure 19C:
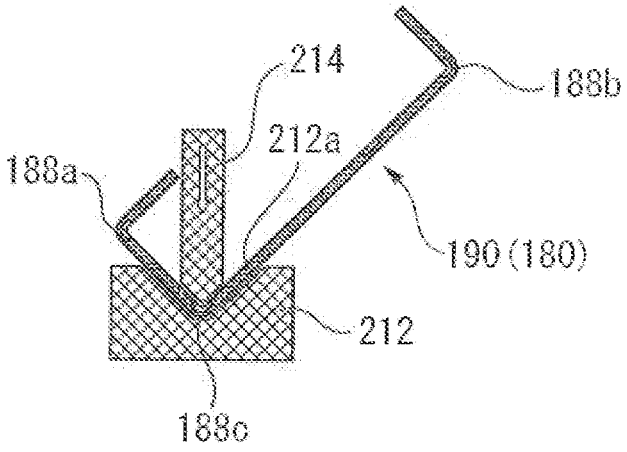
FIG. 19C is a schematic process chart for explaining an example of bending process.
Figure 19D:
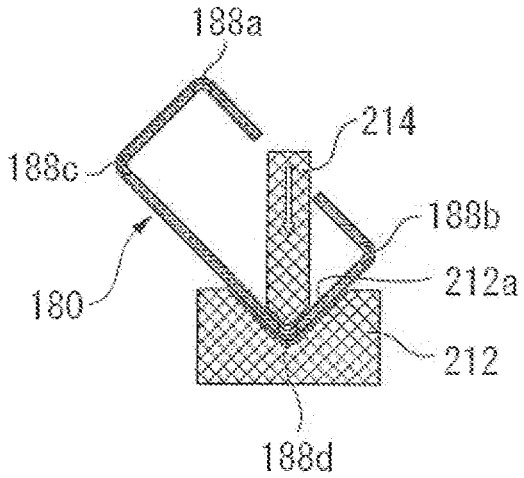
FIG. 19D is a schematic process chare for captaining an example of bending process.

A unit of length numerical numbers in FIGS. 18A and 18B is millimeters (mm). As shown in FIG. 18B, width B of a low-hardness region 192 of blank 190 is 7 mm, and thus the width of each of grooves 206 of upper mold 204 of mold device 200 is also 7 mm.

In relation to example 4 obtained as described above, an average hardness of high-hardness region 194 (Hvh) and an average hardness of low-hardness region 192 (Hvl) of blank 190 were measured, and a ratio of the hardness of the low-hardness region relative to the hardness of the high-hardness region (Hvl/Hvh×100%) was calculated. The result is indicated in Table 6.

TABLE 6

| | Average hardness (Hv) | | Hardness |
|---|---|---|---|
| | High-hardness region | Low-hardness region | ratio (%) |
| Inv. ex. 4 | 503 | 339 | 67 |
| Inv. ex. 5 | 501 | 336 | 67 |
| Comp. ex. 4 | 504 | — | — |

Sheet metal SM2 similar to example 4 was prepared, and heated by means of a heating furnace to 900 degrees C. (the heating process). After that, by using a mold (not shown) similar to lower mold 202 of mold device 200 of FIG. 18A, one side of the sheet metal was cooled under the same cooling condition as high-hardness region 194 of blank 190 in example 4 (the hardening process). As a result, a blank of example 5 was obtained, wherein the entirety of one side of the blank was high-lowhardness region and the entirety of the other side of the blank was low-hardness region, and the entirety of the blank was constituted by the objective region to be processed. In example 5, the contact time between the sheet metal and the mold, was 8 seconds. Table 6 indicates average hardness of the high-hardness region (Hvh) and average hardness of the low-hardness region (Hvl) of the blank of example 5.

Also, sheet metal SM2 similar to example 4 was prepared, and heated by means of a heating furnace to 900 degrees C. (the heating process). After that, by using a mold, the entirety of the sheet metal was cooled under the same cooling condition as high-hardness region 194 of blank 190 in example 4 (the hardening process. As a result, a blank of comparative example 4 was obtained, wherein the entirety of the blank was constituted by the high-hardness region without including the low-hardness region. Table 6 indicates average hardness (Hvh) of comparative example 4.

The tensile strength of the blank of comparative example 4 in Table 6 was 1690 MPa. From this, it can be estimated that the tensile strength of the high-hardness regions of the blanks (sheet metal SM2) of examples 4 and 5 of the invention, having the same chemical compositions and the same average hardness as comparative example 4, were generally equal to 1690 MPa.

As indicated in Table 6, the hardness ratio (Hvl/Hvh×100%) was 67% in both of examples 4 and 5. Further, the tensile strength of the blank of comparative example 4 was 1200 MPa or more.

After that, as shown in FIGS. 19A to 19D, by bending each objective region 196 to be processed of blank 190 of example 4 by means of a press brake so that low-hardness region 192 is inside the objective region, four deformed portions 188*a*, 188*b*, 188*c* and 188*d* (FIG. 20) were sequentially formed in channel-shaped product 180, whereby a product PP1 was obtained (the bending process).

In FIGS 19A to 19D, press brake 210 includes a lower mold (or a die) 212 having a V-shaped groove 212*a* corresponding to an outer shape of each deformed portion 188*a*, 188*b*, 188*c* and 188*d* of product 180; and an upper mold (or a punch) 214 having a front shape corresponding to groove 212*a* of lower mold 212. One objective region to be processed was selected from four objective regions 196 of blank 190, and the selected region was positioned between lower mold 212 and upper mold 214. Then, upper mold 214 was downwardly moved toward lower mold 212 so as to press and bend objective region 196 by lower and upper molds 212 and 214. Such operations were sequentially carried out in relation to other objective regions 196.

By a bending process wherein objective regions 196 of blank 190 of example 4 was bent by means of a 21-stage roll forming machine so that low-hardness region 192 is inside the objective region, deformed portions 188*a*, 188*b*, 188*c* and 188*d* (FIG. 20) of channel-shaped product 180 were sequentially formed, whereby a product PP2 was obtained (the bending process).

By a bending process wherein the blank of example 5 was bent by means of a press brake similarly to the process for product PP1, a channel-shaped product PP3 as shown in FIG. 20 was manufactured.

By a bending process wherein the blank of example 5 was bent by means of a 21-stage roll forming machine similarly to the process for product PP2, a channel-shaped, product PP4 as shown in FIG. 20 was manufactured.

By a bending process wherein the blank of comparative example 4 was bent by means of a press brake similarly to the process for product PP1, a channel-shaped product PP5 as shown in FIG. 20 was manufactured.

Further, by a bending process wherein the comparative example 4 was bent by means of a 21-stage roll forming machine similarly to the process for product PP2, a channel-shaped product PP6 as shown in FIG. 20 was manufactured.

In relation to products PP1 to PP6 obtained as such, a bending test was carried out, and a result thereof is indicated in Table 7.

TABLE 7

| Formed product No. | Blank | Result of forming: Forming method | Result of forming: Corner crack | Result of bending test: Peak load P (kN) | Result of bending test: Corner crack | Result of bending test: Absorption energy E (J) |
|---|---|---|---|---|---|---|
| PP1 | Inv. ex. 4 | Press brake | No crack | 38.6 | No crack | 1611 |
| PP2 | | Roll forming | No crack | 39.1 | No crack | 1515 |
| PP3 | Inv. ex. 5 | Press brake | No crack | 35.4 | No crack | 1265 |
| PP4 | | Roll forming | No crack | 35.7 | No crack | 1277 |
| PP5 | Comp. ex. 4 | Press brake | No crack | 39.0 | Crack | 859 |
| PP6 | | Roll forming | Crack | — | — | — |

Figure 21A:
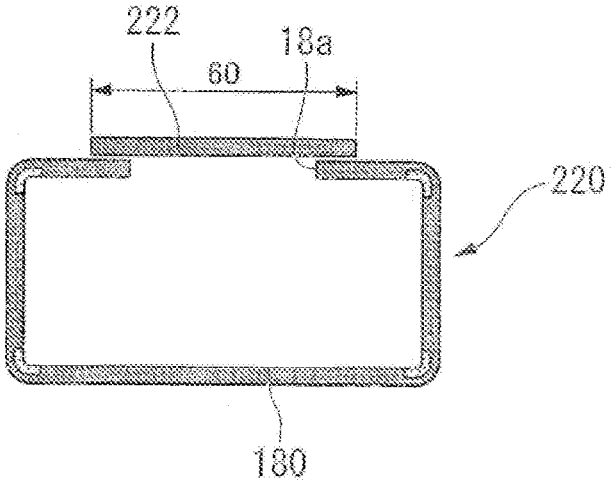
FIG. 21A is a schematic end view of a test piece for carrying out a bending test.

A test piece 220 as shown in FIG. 21A is constituted by a hollow member including product 180 and a steel plate 222 jointed to an opening 180*a* of product 180 by arc welding. The bending test was carried out by using products PP1 to PP6 as product 180. As steel plate 222, a sheet metal of the same material as the sheet metal for manufacturing products PP1 to PP6, and having a width of 60 mm, a length of 1200 mm, and a thickness of 1.2 mm, was prepared. The above heating process and hardening process were carried out in relation to the sheet metal so that the sheet metal had the hardness equivalent to high-hardness region 194.

Figure 21B:
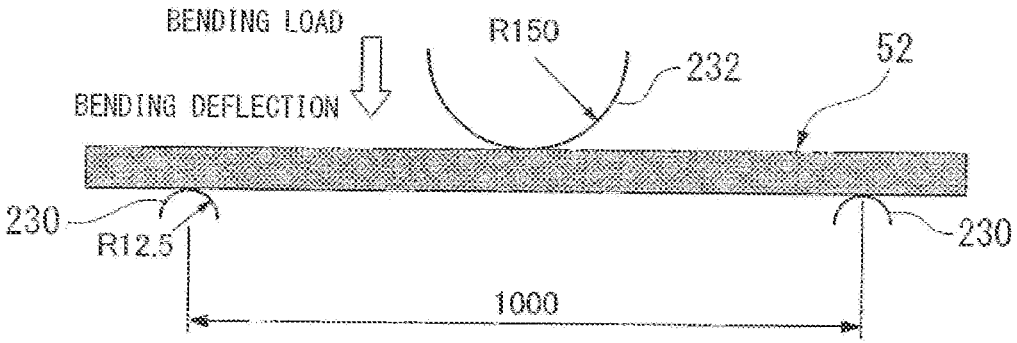
FIG. 21B is a schematic view for explaining a method of a bending test.

Next, tubular test piece 220 obtained as such was positioned so that steel plate 222 was directed downward, as shown in FIG. 21B, and was positioned so as to form a beam of test piece 220 having a span of 1000 mm between two fulcrum points 230, 230, each fulcrum point providing with a front end having a hemispherical shape of a radius of 12.5 mm. Then, a three-point bending test was carried out by positioning a jig 232 having a hemispherical shape of a radius of 150 mm at the center of the beam, and peak load (or maximum load) of the bending load an absorption energy to a bending deflection of 50 mm were determined.

In addition, in relation to products PP1 to PP6, the existence of a crack (or a corner crack) in deformed portions 188*a*, 188*b*, 188*c* and 188*d* were visually checked in the bending process and the bending test. The result was indicated in Table 7.

As indicated in Table 7, in products PP1 to PP4 using the blanks of example 4 and 5, the corner crack did not occur in the bending process and the bending test.

The peak load of product PP1 was slightly lower than product PP5 manufactured by using the sheet metal having the same compositions in the same method. On the other hand, the absorption energy of product PP1 was significantly higher than product PP5.

The absorption energy of products PP2 to PP4 was 1200 J or more, which was significantly higher than product PP5 manufactured by using the sheet metal having the same compositions.

In product PP5 manufactured by bending the blank of comparative example 4 by means of the press brake, although the corner crack did not occur in the bending process, the corner crack occurred in the bending test.

Further, in product PP6 manufactured by bending the blank of comparative example 4 by means of the roll forming machine, the corner crack occurred in the bending process, and the bending test could not be carried out.

Figure 22A:
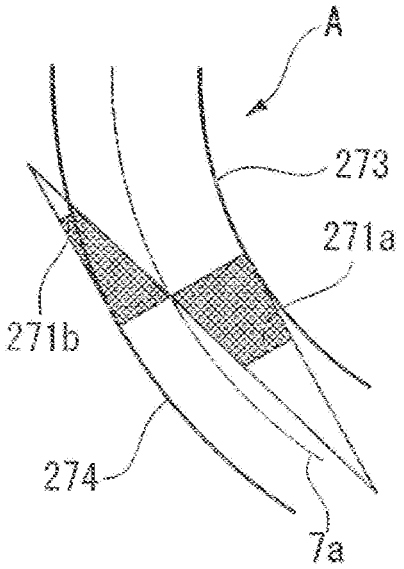
FIG. 22A is a view for explaining stress applied to a deformed portion which is deformed by forming process of a sheet metal, showing a schematic cross-section of the deformed portion wherein hardness of an inside region the deformed portion is lower than hardness of an outside region of the deformed portion.

Hereinafter, with reference to FIGS. 22A to 23B, a stress applied to a deformed portion by the bending process and the shape of the bended deformed portion will be explained, in relation to a sheet metal "A" wherein the hardness of a region inside the deformed portion is lower than the hardness of a region outside the deformed portion; and a sheet metal "B" wherein the hardness of the deformed portion is constant in the thickness direction thereof. As shown in FIG. 22A, in sheet metal A wherein the hardness of region 203 inside the deformed portion is lower than the hardness of region 274 outside the deformed portion, when the stress is applied to sheet metal A so as to deform the sheet metal, a compressive stress is applied to region 273 inside the deformed portion and a tensile stress is applied to region 274 outside the deformed portion. In sheet metal A, since the hardness of region 273 inside the deformed portion is different from the hardness of region 274 outside the deformed portion, the magnitudes of the stress when the plastic deformation is initiated are also different in regions 273 and 274.

Concretely, since the hardness region 273 inside the deformed portion of sheet metal A is lower than the hardness of region 274, region 273 is easily plastically deformed by relatively low stress. Therefore, in sheet metal A, region 273 inside the deformed portion is plastically deformed by the stress for deforming sheet metal A, in advance of region 274 outside the deformed portion. After that, region 274 outside the deformed portion is plastically deformed as well as region 273, and finally, the deformed portion having a predetermined shape as shown in FIG. 23B is obtained.

In the deformed portion of sheet metal A deformed as such, as shown in FIG. 22A, a compressive strain 271*a* of inside region 273 is larger than a tensile strain 271*b* of outside region 274, Therefore, in the deformed portion of sheet metal A, as shown in FIG. 22A, a neutral axis 7*a*, at which the compressive stress of inside region 273 and the tensile stress of outside region 274 balance, is positioned outside an intermediate position of sheet metal A in the thickness direction thereof.

Figure 22B:
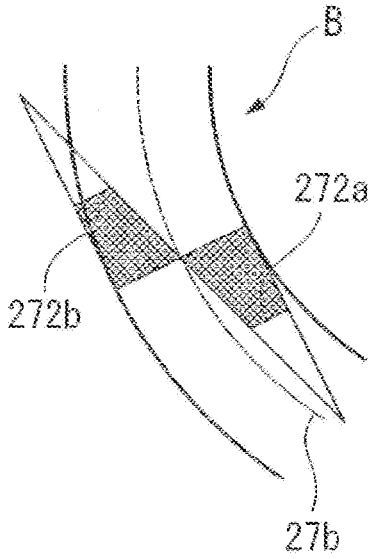
FIG. 22B is a view for explaining stress applied to a deformed portion which is deformed by forming process of a sheet metal, showing a schematic cross-section of the deformed portion wherein hardness of the deformed portion is constant in the thickness direction thereof.

Also, as shown in FIG. 22B, in sheet metal B wherein the hardness of the deformed portion is constant in the thickness direction thereof, when the stress is applied to sheet metal B so as to deform the sheet metal, a compressive stress is applied to a region inside the deformed portion and a tensile stress is applied to a region outside the deformed portion. However, unlike sheet metal A, since the hardness of the region inside the deformed portion is the same as the hardness of the region outside the deformed portion in sheet metal B, the magnitudes of the stress when the plastic deformation is initiated are the same in the regions.

Figure 23A:
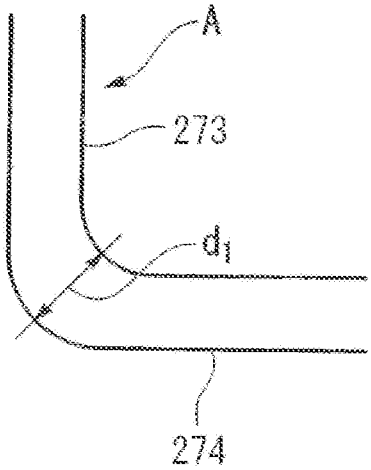
FIG. 23A is a view for explaining stress applied to a deformed portion which is deformed by forming process of a sheet metal, showing a schematic cross-section of the deformed portion of sheet metal A of FIG. 22A wherein hardness of the deformed portion is uniform in the thickness direction thereof.
Figure 23B:
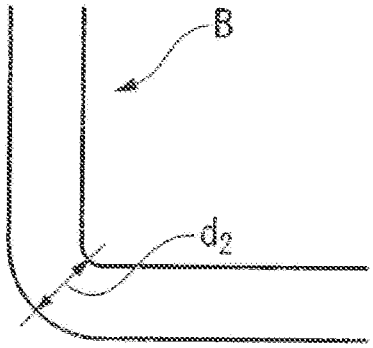
FIG. 23B is a view for explaining a shape of a deformed portion which is deformed by forming process of a sheet metal, showing a schematic cross-section of the deformed portion of sheet metal B of FIG. 22B.

Therefore, in sheet metal B, by the stress for deforming sheet metal B, the region inside the deformed portion is plastically deformed simultaneously with the region outside the deformed portion, and finally, the deformed portion having a predetermined shape as shown in FIG. 23B is obtained. In the deformed portion of sheet metal B deformed as such, as shown in FIG. 22B, a compressive strain 272*a* of the inside region is equal to a tensile strain 272*b* of the outside region. Therefore, in the deformed portion of sheet metal B, as shown in FIG. 22B, a neutral axis 27*b*, at which the compressive stress of the inside region and the tensile stress of the outside region balance, is positioned at an intermediate position of sheet metal B in the thickness direction thereof.

As explained above, in sheet metals A and B, in relation to the stress generated by the bending process, the ratio of compressive strain 271*a* and tensile strain 271*b* is different from the ratio of compressive strain 272*a* and tensile strain 272*b*. Further, in the deformed portion of sheet metal A, unlike sheet metal B, in relation to the stress generated by the bending process, compressive strain 271*a* of inside region 273 is larger than tensile strain 271*b* of outside region 274. In this regard, since inside region 273 of the deformed portion is a region having low hardness in sheet metal A, a crinkle and a crack are unlikely to be generated by the bending process, and the inside region, is deformed so as to inwardly bulge at the deformed portion, as shown in FIG. 23A.

In addition, in the deformed portion of sheet metal A, unlike sheet metal B, in relation to the stress generated by the bending process, tensile strain 271*b* of outside region 274 is smaller than compressive strain 271*a* of inside region 273, whereby the load applied to outside region 274 due to the bending process is reduced. By virtue or this, although outside region 272 of the deformed portion is a region having high hardness in sheet metal A where a crinkle and a crack are likely to be generated, disadvantages due to the bending process can be avoided. Therefore, the disadvantages due to the bending process are unlikely to be generated in sheet metal A, and sheet metal A can be easily bent.

Further, as shown in FIG. 23A, the deformed portion of sheet metal A is deformed so as to inwardly budge, due to the difference between compressive strain 271*a* and tensile strain 271*b* generated by the stress for the deformation. By virtue of this, for example, when sheet metals A and B have the same thickness and the sheet metals are deformed by the bending process so as to have the same outside shape, a maximum thickness d1 of the deformed portion of sheet metal A is larger than a maximum thickness d2 of the deformed portion of sheet metal B.

Accordingly, a product obtained by the bending process of sheet metal A is reinforced by the relatively large maximum thickness d1 of the deformed portion. By virtue of this, the product obtained by the bending process of sheet metal A has high strength, nevertheless the hardness of inside region 273 of the deformed portion is lower than outside region 274. Further, in the product obtained by the bending process of sheet metal A, a strain, which is generated by the load during use, becomes smaller in outside region 274 having the hardness higher than inside region 273, similarly to in the bending process, whereby the load applied to outside region 274 (where a crack is likely to be generated) during use can be reduced. Therefore, in comparison to a product obtained by the bending process of sheet metal B, the entire of which has she same hardness as outside region 274 of the deformed portion, a crack is unlikely to be generated in the product obtained by the bending process of sheet metal A due to the load during use.

REFERENCE SIGNS LIST

10 blank
12 low-hardness region

14 high-hardness region
20 product
22 bottom wall
24 side wall
26 deformed portion
20 mold device
32 bed
34 lower mold
36 upper mold
38 drive unit
40 cooling device
42 lower nozzle
44 upper nozzle
46 lower masking member
48 upper masking member
50 product
52 rectangular column portion
54 bottom wall or connecting portion
60 product
60*a* opening
62 bottom wall
64 side wall
66 pair of flange portions
68 deformed portion
70 mold device
72 lower mold
74 upper mold
76 groove
78 groove
80 blank
82 low-hardness region
84 high-hardness region
90 press brake
92 lower mold
92*a* V-shaped groove
94 upper mold

The invention claimed is:

1. A method for bending a sheet metal, the method comprising:

a hardness adjusting process for changing hardness of at least a part of the sheet metal so as to form a blank including a high-hardness region and a low-hardness region having a hardness lower than a hardness of the high-hardness region; and a bending process for bending an objective region to be processed, which includes the low-hardness region and the high-hardness region of the blank, so as to form a product, wherein the hardness adjusting process comprises forming the objective region to be processed in at least a part of the sheet metal, wherein one side of the sheet metal is formed as the low-hardness region and the other side of the sheet metal is formed as the high-hardness region.

2. The method for bending a sheet metal according to claim 1, wherein the hardness adjusting process includes a heating process for heating an entirety of the sheet metal and a hardening process for quenching only a region to be the high-hardness region.

3. The method for bending a sheet metal according to claim 2, wherein the hardening process is a process for cooling only the region to be the high-hardness region by using a mold.

4. The method for bending a sheet metal according to claim 2, wherein the hardening process is a process for water-cooling only the region to be the high-hardness region.

5. The method for bending a sheet metal according to claim 1, wherein the hardness adjusting process comprises a welding process for positioning another sheet metal, having hardness different from the hardness of the sheet metal, in a region to be the high-hardness region or the low-hardness region, and welding the sheet metals to each other.

6. The method for bending a sheet metal according to claim 1, wherein the hardness adjusting process is a process for heating a region to be the low-hardness region of the sheet metal, by using a laser.

7. The method for bending a sheet metal according to claim 1, wherein the hardness of the low-hardness region is within a range from 30% to 70% of the hardness of the high-hardness region.

8. The method for bending a sheet metal according to claim 1, wherein the low-hardness region of the blank is deformed by using a press brake in the bending process.

9. The method for bending a sheet metal according to claim 1, wherein the low-hardness region of the blank is deformed by roll forming in the bending process.

10. A product manufactured by the method for bending a sheet metal according to claim 1.

11. The product according to claim 10, wherein the sheet metal is a high-strength steel sheet having tensile strength of 980 MPa or more.

12. The product according to claim 11, wherein Vickers hardness of a region other than the deformed portion which is deformed by the bending process is 310 or more, and the hardness of the deformed portion is within a range from 40% to 80% of the hardness of the region other than the deformed portion.

13. The method for bending a sheet metal according to claim 1, wherein the sheet metal is a high-strength steel sheet having tensile strength of 980 MPa or more.

14. The method for bending a sheet metal according to claim 1, wherein the hardness adjusting process comprises a heating process for heating at least the objective region over a thickness direction of the sheet metal, and a hardening process for cooling a surface which corresponds to the side of the objective region having higher hardness.

15. The method for bending a sheet metal according to claim 14, wherein the hardening process is a process for cooling the surface which corresponds to the side of the objective region having higher hardness.

16. The method for bending a sheet metal according to claim 14, wherein the hardening process is a process for water-cooling the surface which corresponds to the side of the objective region having higher hardness.

17. The method for bending a sheet metal according to claim 1, wherein the hardness adjusting process is a shot-peening process applied to one side of the sheet metal to be at least the objective region.

18. The method for bending a sheet metal according to claim 1, wherein the hardness of the side of the objective region having lower hardness is within a range from 30% to 80% of the hardness of the side of the objective region having higher hardness.

19. The method for bending a sheet metal according to claim 1, wherein the blank is deformed by roll forming in the bending process.

20. The method for bending a sheet metal according to claim 1, wherein the sheet metal is a high-strength steel sheet having tensile strength of 980 MPa or more.

21. A method for manufacturing a blank as a product by carrying out a bending process, the method comprising:

a process for changing hardness of at least a part of a sheet metal so as to form a blank having an objective region to be processed, which includes a high-hardness region and a low-hardness region having a hardness lower than a hardness of the high-hardness region, wherein the objective region to be processed is formed in a region of the blank including a region which is deformed by the bending process, and wherein one side of the sheet metal is formed as the low-hardness region, and the other side of the sheet metal is formed as the high-hardness region.

22. The method for manufacturing a blank according to claim 21, wherein the sheet metal is a high-strength steel sheet having tensile strength of 980 MPa or more.

23. A product manufactured by the method for bending a sheet metal according to claim 21.

24. A blank according to claim 23, wherein the sheet metal is a high-strength steel sheet having tensile strength of 980 MPa or more.

25. A method for manufacturing a blank by carrying out bending process, the method comprising:

a process for changing hardness of a sheet metal in a thickness direction thereof so as to form a blank having an objective region to be processed, the objective region being formed in at least a part of the sheet metal so that the objective region includes front and back sides having different hardness, wherein the side of the objective region having lower hardness is formed in an inside region of a deformed portion which is deformed by the bending process.

26. The method for manufacturing a blank according to claim 25, wherein the sheet metal is a high-strength steel sheet having tensile strength of 980 MPa or more.

27. The method for manufacturing a blank according to claim 25, wherein Vickers hardness of a region other than the deformed portion which is deformed by the bending process is 310 or more, and the hardness of inside of the deformed portion is within a range from 40% to 85% of the hardness of the region other than the deformed portion.

* * * * *